US007979011B2

(12) United States Patent
Fujihara et al.

(10) Patent No.: US 7,979,011 B2
(45) Date of Patent: Jul. 12, 2011

(54) IMAGE FORMING APPARATUS HAVING A PHOTOCONDUCTIVE DRUM

(75) Inventors: Kensuke Fujihara, Osaka (JP); Akane Tokushige, Osaka (JP); Tamotsu Shimizu, Osaka (JP); Ryota Maeda, Osaka (JP); Koji Fujii, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 6 days.

(21) Appl. No.: 12/546,845

(22) Filed: Aug. 25, 2009

(65) Prior Publication Data

US 2010/0054820 A1 Mar. 4, 2010

(30) Foreign Application Priority Data

Aug. 27, 2008 (JP) ..... 2008-218785
Aug. 27, 2008 (JP) ..... 2008-218794
Aug. 27, 2008 (JP) ..... 2008-218797

(51) Int. Cl.
*G03G 15/09* (2006.01)

(52) U.S. Cl. ..... 399/270; 399/55

(58) Field of Classification Search ..... 399/38, 399/53, 55, 56, 252, 265–267, 270
See application file for complete search history.

(56) References Cited

U.S. PATENT DOCUMENTS 5,202,731 A * 4/1993 Tanikawa et al. ..... 399/270
6,782,226 B2 8/2004 Machida et al.
6,917,780 B2 * 7/2005 Ozawa et al. ..... 399/282
7,761,040 B2 * 7/2010 Uetake et al. ..... 399/272

FOREIGN PATENT DOCUMENTS

JP 3815356 6/2006

* cited by examiner

*Primary Examiner* — Hoan Tran
(74) *Attorney, Agent, or Firm* — Smith, Gambrell & Russell, LLP

(57) ABSTRACT

An image forming apparatus that includes: a photoconductive drum; a developing roller that is arranged opposite the photoconductive drum and that carries toner; a detecting portion that detects an occurrence of electrical discharge between the developing roller and the photoconductive drum; a control portion that controls the apparatus, that receives an output of the detecting portion and then recognizes the occurrence of the electrical discharge; a direct voltage applying portion that is connected to the developing roller; and an alternating voltage applying portion is disclosed herein.

17 Claims, 16 Drawing Sheets

(b)

--Prior Art--

IMAGE FORMING APPARATUS HAVING A PHOTOCONDUCTIVE DRUM

This application is based on the following Japanese Patent Applications, the contents of which are hereby incorporated by reference:

(1) Japanese Patent Application No. 2008-218785 (filed on Aug. 27, 2008);

(2) Japanese Patent Application No. 2008-218794 (filed on Aug. 27, 2008); and (3) Japanese Patent Application No. 2008-218797 (filed on Aug. 27, 2008).

BACKGROUND OF THE INVENTION

1. Field of the Invention

The present invention relates to an image forming apparatus such as a copier, a printer, a facsimile, a multifunctional apparatus, and the like.

2. Description of Related Art

Among the image forming apparatuses using toner, such as a copier, a printer, a facsimile, a multifunctional apparatus, and the like, some have been provided with a photoconductive drum and a developing roller arranged opposite the photoconductive drum with a gap in between. And the so-called developing bias voltage obtained by superimposing a DC component on an AC component is applied to the developing roller. As a result, electrically charged toner particles are transferred from the developing roller to the photoconductive drum, and thereby an electrostatic latent image is developed.

So that the density of an image to be formed is secured by sufficiently supplying toner particles to the photoconductive drum, with the aim of increasing developing efficiency, the alternating (AC) voltage applied to the developing roller has simply to make its peak-to-peak voltage high. Making it too high, however, leads to electrical discharge occurring in the gap between the photoconductive drum and the developing roller. If electrical discharge occurs there, owing to a change in potential on the photoconductive drum surface, an electrostatic latent image will be disturbed, with the result that the quality of a resulting image is degraded. Moreover, a large current will possibly be rushed into the photoconductive drum, making it damaged. Thus, even in a case where the peak-to-peak voltage of the AC voltage is made high, such the voltage leading to electrical discharge should not be applied to the developing roller during the image forming operation.

Thus, so that the developing efficiency is increased with no problem arising from electrical discharge, the alternating (AC) voltage that does not lead to electrical discharge between the photoconductive drum and the developing roller when engaging in the image forming operation, and that is as high as possible is applied to the developing roller. For example, the magnitude of the AC voltage applied to the developing roller is altered to detect the occurrence or non-occurrence of electrical discharge and to thereby find out a peak-to-peak voltage at which the occurrence of electrical discharge is started. Then a potential difference between the developing roller and the photoconductive drum at a time when the electrical discharge has occurred is grasped. After that, setting is done to specify the AC voltage applied to the developing roller so that the image forming operation is performed with a potential difference between the developing roller and the photoconductive drum slightly lower than the potential difference thus grasped.

For example, JP-3815356 discloses a developing apparatus including: an image carrier; and a toner carrier arranged opposite the image carrier with a predetermined interval in between inside a developing region, wherein a developing bias voltage with a direct (DC) voltage superimposed on an alternating (AC) voltage is applied between the toner carrier and the image carrier, toner is supplied to the image carrier, and an electrostatic latent image is developed; the developing apparatus further includes: leak generation means changing a leak detection voltage that is applied between the image carrier and the toner carrier; and a leak detection means detecting a leak, wherein when a maximum potential difference $\Delta V_{max}$ between the leak detection voltage and a potential at a surface of the image carrier is gradually increased, and if a current passing through the image carrier and the toner carrier is successively increased, the leak detection means considers it as the leak (e.g., see JP-3815356, specifically claim 1 and others).

As an example, FIG. 16 shows, by way of example, a relationship of the potential difference between the photoconductive drum and the developing roller versus a discharge current passing through the photoconductive drum and the developing roller. FIG. 16 illustrates a case in which a photoconductive drum having a photoconductive layer formed of amorphous silicon and positively charged is employed. In the example shown in FIG. 16, when the potential of the developing roller is lower than that of the photoconductive drum (in a negative direction), if the potential difference between the developing roller and the photoconductive drum exceeds a certain value, a discharge current is dramatically increased. On the other hand, when the potential of the developing roller is higher than that of the photoconductive drum (in a positive direction), even if the potential difference exceeds that certain value, an increase in the discharge current is moderate compared with that when the potential is in the negative direction. This feature can be observed with the photoconductive layer formed of any other material.

In the developing apparatus disclosed by JP-3815356, the leak detection voltage is altered, and thus, the electrical discharge may take place in the negative direction, possibly leading to the large amount of discharge current made to pass. Additionally, an increase in current is checked by gradually increasing the maximum potential difference $\Delta V_{max}$ between the leak detection voltage and a surface potential of the image carrier. Thus, there is a strong possibility that an accordingly large discharge current forms an ultra-small hole called "drum pinhole" in the photoconductive drum. That is, the photoconductive drum is highly likely to be damaged. If such a drum pinhole is formed, it is impossible to carry electrical charges and hence toner particles there. This adversely affects the quality of an image to be formed in the image forming operation.

SUMMARY OF THE INVENTION

In view of the conventional problems, it is an object of the present invention to help reduce damage on a photoconductive drum, and to measure a potential difference between that photoconductive drum and a developing roller at which the occurrence of electrical discharge is started.

To achieve the above object, an image forming apparatus according to one aspect of the present invention includes: a photoconductive drum that carries a toner image on a circumferential surface thereof; a developing roller that is arranged opposite the photoconductive drum with a gap in between, and that carries toner when engaging in an image forming operation; a detecting portion that detects an occurrence of electrical discharge between the photoconductive drum and the developing roller; a control portion that controls the apparatus, that receives an output of the detecting portion, and that recognizes, based on the output, the occurrence of the electrical discharge; a direct (DC) voltage applying portion that is connected to the developing roller so as to supply toner to the photoconductive drum; and an alternating (AC) voltage applying portion that is connected to the developing roller so as to supply the toner to the photoconductive drum, and that, when an electrical discharge detecting operation is performed in which the occurrence of the electrical discharge is detected by use of the detecting portion with an alternating voltage applied to the developing roller changed step by step in accordance with an instruction from the control portion, applies, to the developing roller, the alternating voltage having a duty ratio and a frequency different from the AC voltage applied for the image forming operation, so that the electrical discharge is made to occur simply in a direction in which an increase in current induced by the electrical discharge is smaller for an increase in potential difference, grasped in advance, between the photoconductive drum and the developing roller.

To grasp a peak-to-peak voltage (potential difference between the developing roller and the photoconductive drum) at which the occurrence of electrical discharge is started, electrical discharge is intentionally produced by changing the AC voltage applied to the developing roller, and thereby the occurrence of electrical discharge is detected and confirmed. A direction in which an increase in current induced by the electrical discharge is smaller is grasped in advance for an increase in the potential difference between the photoconductive drum and the developing roller. For the electrical discharge detecting operation as described above, the AC voltage applying portion applies the AC voltage having a duty ratio and a frequency different from the duty ratio and the frequency of the AC voltage applied for an image forming operation, so that electrical discharge is produced in the direction in which the increase in current induced by the electrical discharge is smaller.

For example, among the photoconductive drums having a photoconductive layer formed of amorphous silicon and positively charged, there is one having a feature that a current abruptly induced by electrical discharge does not pass between the developing roller and the photoconductive drum if the developing roller has a potential higher than the photoconductive drum.

In a case where the photoconductive drum as described above is employed, the AC voltage having the duty ratio and the frequency smaller than the duty ratio and the frequency for the image forming operation is applied to the developing roller, the frequency being set smaller so that a period on a positive side becomes equal to that for the image forming operation. With the duty ratio of the AC voltage smaller than that for the image forming operation, a difference between a peak value on the positive side and a center of a waveform formed by two peaks (mean value of the AC voltage), namely a DC bias applied by the DC voltage applying portion, can be made large.

Accordingly, a potential difference between the peak value on the positive side of the AC voltage and the surface potential of the photoconductive drum can be made large, and thus, electrical discharge can be intentionally produced with the potential of the developing roller higher than that of the photoconductive drum. That is, by altering the duty rate of the AC voltage, a direction in which a discharge current is induced can be controlled. For example, in a case where a photoconductive drum has a feature that a current abruptly induced by electrical discharge does not pass between the developing roller and the photoconductive drum if the developing roller has a potential higher than the photoconductive drum, it is less likely that the photoconductive drum will be damaged by electrical discharge. That is, the peak-to-peak voltage at which the occurrence of electrical discharge is started (i.e., potential difference between the photoconductive drum and the developing roller at which the occurrence of electrical discharge is started) can be measured with no damage to the photoconductive drum.

Moreover, so that a period for which the alternating (AC) voltage remains positive is equal to that for the image forming operation, the AC voltage having its frequency set smaller than that for the image forming operation is applied to the developing roller; thus, even though the AC voltage takes time in rising and falling, the period for which the AC voltage remains positive can be secured like that for the image forming operation. Thus, the state of the AC voltage being applied for the electrical discharge detecting operation can be matched with that for the image forming operation.

DETAILED DESCRIPTION OF PREFERRED EMBODIMENTS

Hereinafter, a first embodiment of the present invention will be described with reference to FIGS. 1 to 9. This embodiment illustrates, by way of example, an electrophotographic-tandem-type color printer 1 (corresponding to an image forming apparatus). The present invention is applicable to image forming apparatuses ranging from a printer to a copier, and to a multifunction machine, and the like. Any features such as a configuration and an arrangement described in this embodiment are not meant to limit the scope of the invention, and are illustrative only.

(Outline of a Configuration of the Image Forming Apparatus)

Figure 1:
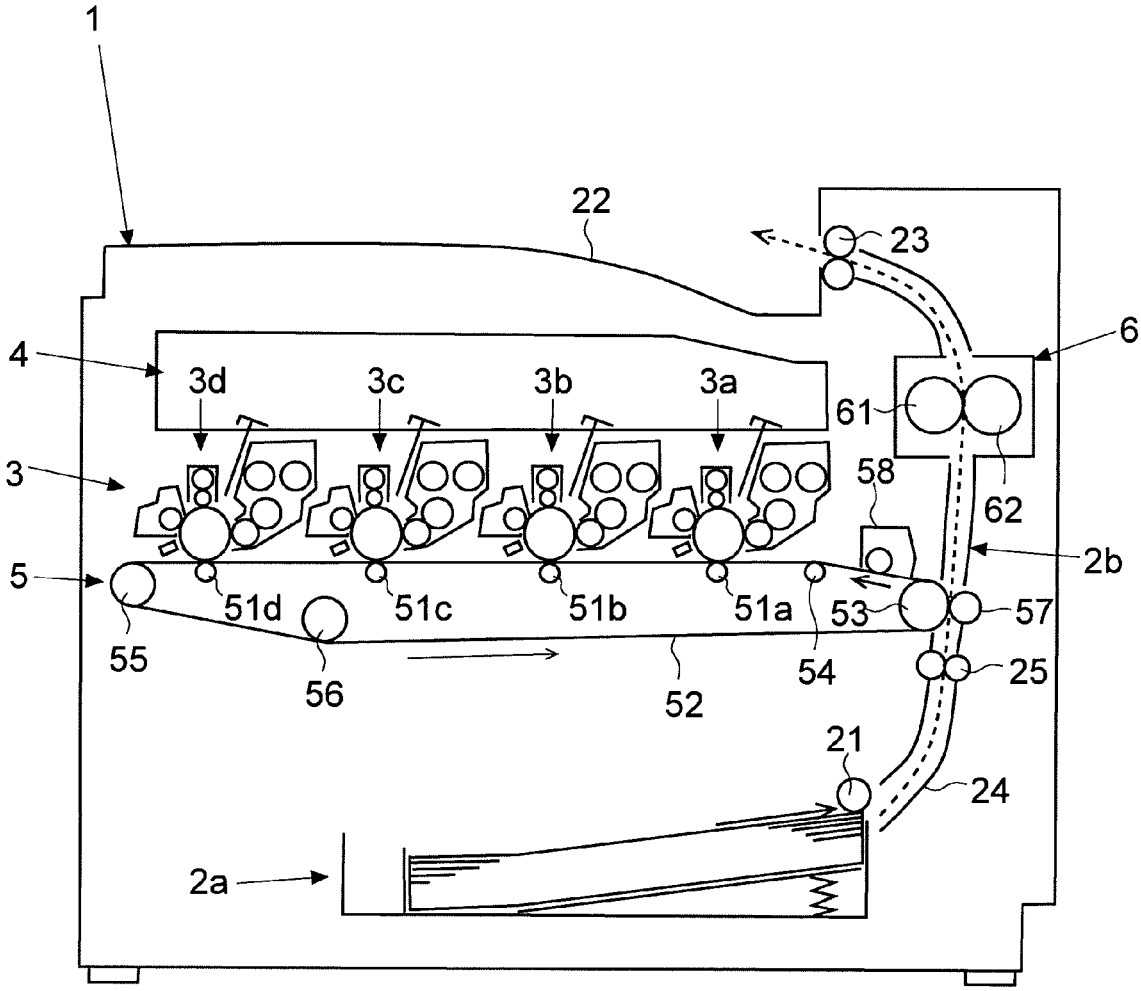
FIG. 1 is a cross-sectional view schematically showing a configuration of a printer according to a first embodiment of the present invention.
Figure 2:
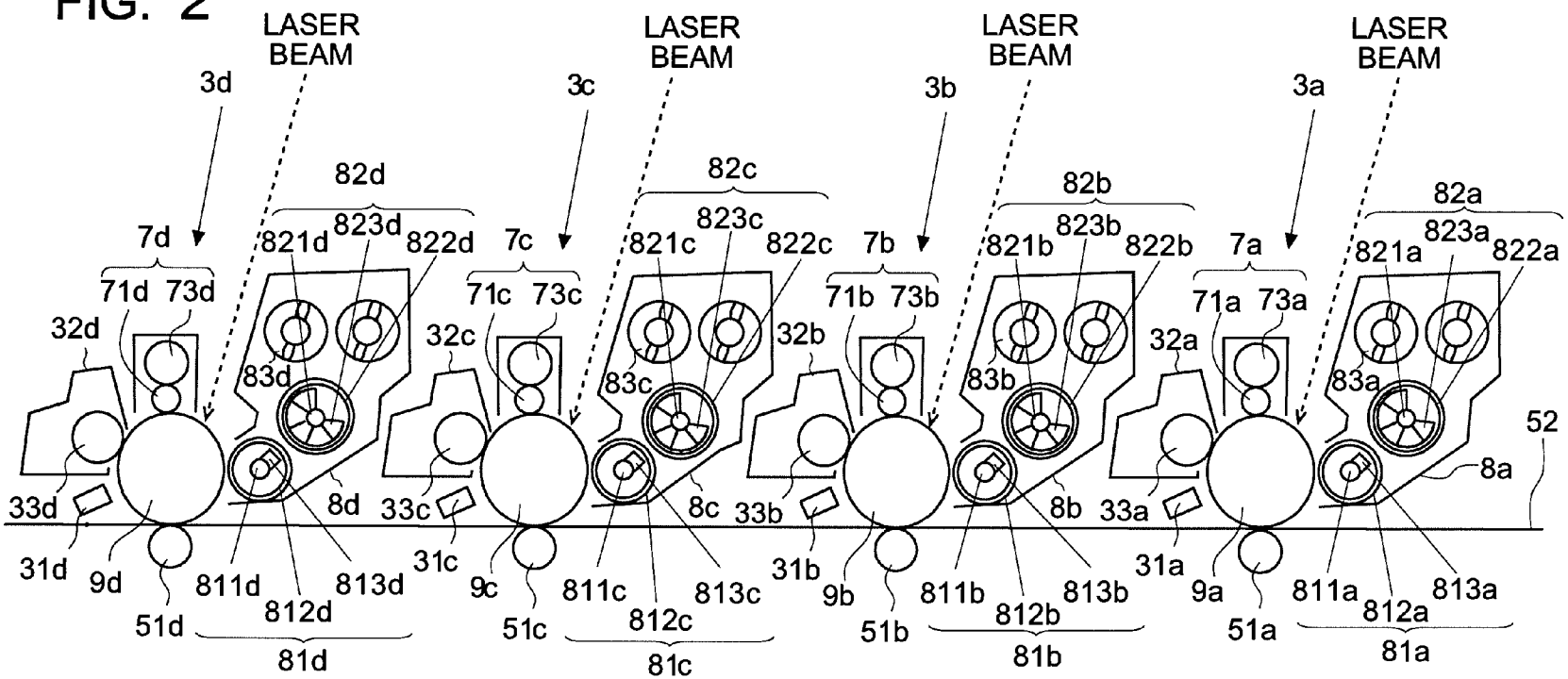
FIG. 2 is an enlarged cross-sectional view showing each of image forming portions according to the first embodiment of the present invention.
Figure 3:
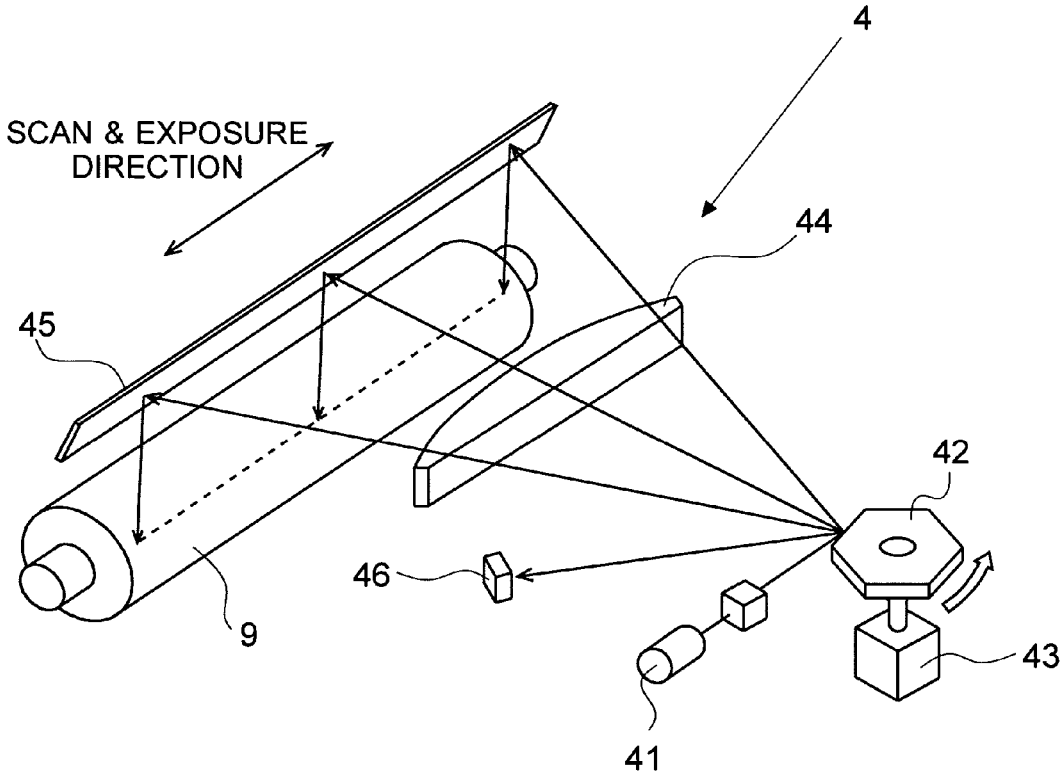
FIG. 3 is a schematic view showing an example of an exposure apparatus according to the first embodiment of the present invention.

First, an outline of a printer 1 according to the first embodiment of the present invention will be described with reference to FIGS. 1 to 3. FIG. 1 is a cross-sectional view schematically showing a configuration of the printer 1 according to the first embodiment of the present invention. FIG. 2 is an enlarged cross-sectional view showing each of image forming portions 3 according to the first embodiment of the present invention. FIG. 3 is a schematic view showing an example of an exposure apparatus 4 according to the first embodiment of the present invention. The printer 1 of this embodiment includes: inside a body thereof, a sheet feeding portion 2*a*; a sheet conveyance passage 2*b*; an image forming portion 3; an exposure apparatus 4; an intermediate transfer portion 5; an fixing apparatus 6, and the like.

The sheet feeding portion 2*a* contains various kinds of sheets, examples of which including copy sheets, OHP sheets, and label sheets. The sheet feeding portion 2*a* feeds a sheet into the sheet conveyance passage 2*b* by use of a sheet feeding roller 21 that is rotated by a driving mechanism such as a motor (not shown). The sheet conveyance passage 2*b* then conveys that sheet inside the printer 1. The sheet conveyance passage 2*b* guides a sheet fed from the sheet feeding portion 2*a*, up to a sheet ejected tray 22 via the intermediate transfer portion 5 and the fixing apparatus 6. The sheet conveyance passage 2*b* is equipped with a pair of conveyance rollers 23 and a guide 24. Moreover, the sheet conveyance passage 2*b* is equipped with a pair of resist rollers 25 making a sheet so conveyed wait before the intermediate transfer portion 5 and then fed into the intermediate transfer portion 5 at appropriate timing.

As shown in FIGS. 1 and 2, the printer 1 is provided with image forming portions 3, one for each of four colors, as sections each forming a toner image based on image data of an image to be formed. Specifically, the printer 1 is provided with: an image forming portion 3*a* forming a black toner image (equipped with a charging apparatus 7*a*, a developing apparatus 8*a*, an electrical-charge eliminating apparatus 31*a*, a cleaning apparatus 32*a*, and the like); an image forming portion 3*b* forming a yellow toner image (equipped with a charging apparatus 7*b*, a developing apparatus 8*b*, an electrical-charge eliminating apparatus 31*b*, a cleaning apparatus 32*b*, and the like); an image forming portion 3*a* forming a cyan toner image (equipped with a charging apparatus 7*c*, a developing apparatus 8*c*, an electrical-charge eliminating apparatus 31*c*, a cleaning apparatus 32*c*, and the like); and an image forming portion 3*d* forming a magenta toner image (equipped with a charging apparatus 7*d*, a developing apparatus 8*d*, an electrical-charge eliminating apparatus 31*d*, a cleaning apparatus 32*d*, and the like).

The image forming portions 3*a* to 3*d* will be described with reference to FIG. 2. They are basically the same in configuration but are simply different in color of a toner image they each form. In the following description, suffixes a, b, c, and d added to the image forming portion 3 will not be given unless necessary for specifically describing. Note that in FIG. 2, members forming the image forming portions 3*a*, 3*b*, 3*c*, and 3*d* are given the suffixes a, b, c, and d, respectively, to facilitate identification.

Photoconductive drums 9, carry a toner image on circumferential surfaces thereof. For example, the photoconductive drums 9 each have a photoconductive layer formed of amorphous silicon and positively charged on a circumferential surface of an aluminum-made base body. The photoconductive drums 9 are driven and rotated by use of a driving apparatus (not shown) clockwise as seen in the figure at a predetermined process speed. Note that each of the photoconductive drums 9 of this embodiment is a positively-charged type.

The charging apparatuses 7 (corresponding to a charging portion) are each provided with a charging roller 71, and charges the photoconductive drum 9 at a constant potential. The charging roller 71 makes contact with the photoconductive drum 9, and rotates as the photoconductive drum 9 rotates. Moreover, to the charging roller 71, a charge voltage applying portion 72 (see FIG. 5) applies a voltage obtained by superimposing an AC component on a DC component. Thus, a surface of the photoconductive drum 9 is charged evenly at a predetermined positive potential (e.g., "dark" potential in a range of 200 V to 300 V). Moreover, the charging apparatuses 7 are each equipped with a cleaning brush 73 (e.g., brush, made of resin and the like, wound around a bar). Note that the charging apparatuses 7 may be a corona-discharge type, or may be formed with a brush and the like.

The developing apparatuses 8 each contains a developing agent (so-called two-component developer) including toner particles and magnetic carrier particles. The developing apparatuses 8*a*, 8*b*, 8*c*, and 8*d* contain a black, a yellow, a cyan, and a magenta developer, respectively. The developing apparatuses 8 each include: a developing roller 81; a magnetic roller 82; and a plurality of conveyance members 83. The developing roller 81 is arranged opposite the photoconductive drums 9 with a predetermined gap (e.g., 1 mm or less) in between. The plurality of magnetic rollers 82 are disposed diagonally upper-rightward of the developing roller 81, so that they are spaced apart at a predetermined interval. The conveyance members 83 are disposed above the magnetic roller 82.

The developing roller 81 and the magnetic roller 82 have roller shafts 811 and 821 fixedly disposed, respectively. The roller shafts 811 and 821 of the developing roller 81 and the magnetic roller 82 are equipped with magnets 813 and 823, respectively, extending in each axial direction. The developing roller 81 and the magnetic roller 82 have cylindrical sleeves 812 and 822 mounted thereon, respectively, covering the magnets 813 and 823 and rotated when an image is formed (see FIG. 4). The magnet 813 of the developing roller 81 and the magnet 823 of the magnetic roller 82 assume polarities, as observed at a mutually facing position, so that either of them is opposite the other.

Thus, between the developing roller 81 and the magnetic roller 82, a magnetic brush is formed of magnetic carrier particles. With the magnetic brush, rotation of the sleeve 822, a voltage applied to the magnetic roller 82 (by a magnetic roller bias applying portion 84 shown in FIG. 5), etc. the toner particles are supplied from the magnetic roller 82 to the developing roller 81. As a result, a thin layer of the toner particles is formed on the developing roller 81. Moreover, after development, from the developing roller 81, residual toner particles are scraped by the magnetic brush. The conveyance members 83 are each provided with a blade, for example, in a spiral manner around each shaft. The conveyance members 83 convey and agitate the developer inside the developing apparatus 8, and thereby charges the toner particles electrically at a predetermined level (positively charges them in this embodiment).

The cleaning apparatus 32 cleans the photoconductive drum 9. For example, the cleaning apparatus 32 is provided with a cleaning member 33 formed in a cylindrical shape and having elasticity at its circumferential portion. The cleaning member 33 makes contact with the photoconductive drum 9, and removes and collects the toner particles left on the drum surface after image transfer. Moreover, below the cleaning member 32 is disposed the electrical-charge eliminating apparatus 31 (e.g., an array of LEDs) shining light on the photoconductive drum 9 and thereby eliminating electrical charges carried on the photoconductive drum 9.

The exposure apparatus 4 (corresponding to an exposure portion) disposed above the image forming portion 3 receives image signals separated for each of different color components, converts them into light signals, outputs those light signals in the form of laser beams (indicated by dotted lines in FIG. 2), and thereby scans and exposes the photoconductive drum 9, which is already electrically charged, to form an electrostatic latent image.

Next, an outline of a configuration of the exposure apparatus 4 will be described with reference to FIG. 3. As shown in FIG. 3, the exposure apparatus 4 is provided with: a semiconductor laser apparatus 41 (laser diode); a polygon mirror 42 formed with a plurality of planar reflective surfaces reflecting the laser beams and rotated at a high speed (by use of a polygon motor 43); a fθ lens 44; a mirror 45 reflecting the laser beams appropriately toward the photoconductive drum 9, and the like. Note that FIG. 3 shows the configuration for one color alone, and that in the case of the four colors, the polygon mirror 42 is commonly used, and the other semiconductor laser apparatus 41, the fθ lens 44, the mirror 45, and the like are provided one for each of the colors. With this configuration, the laser beams are irradiated from the exposure apparatus 4 onto the photoconductive drum 9. Then, an electrostatic latent image is formed on the photoconductive drum 9 according to the image data. Specifically, the photoconductive drum 9 of this embodiment is positively charged; thus, a potential thereof is lowered at part irradiated with the laser beams. The positively charged toner particles are thus attracted to that part whose potential is lowered. For example, in the case of a filled-in image, all of the lines and all of the pixels included in it are irradiated with the laser beams. Note that the exposure apparatus 4 is not limited to the laser type such as one formed with a plurality of LEDs.

In the exposure apparatus 4, a light receiving element 46 is disposed within a range where the laser beams can reach but out of a range where the laser beams toward the photoconductive drum 9 travel. The light receiving element 46 outputs current (voltage) when irradiated with the laser beam. This output is, for example, inputted to a CPU (central processing unit) 11 which will be described later, and is then used as a synchronization signal for detecting electrical discharge (see FIG. 5).

The description will now be continued with reference back to FIG. 1. The intermediate transfer portion 5 receives a primary transfer of a toner image from the photoconductive drum 9, and performs a secondary transfer onto a sheet of paper. The intermediate transfer portion 5 is provided with: primary transfer rollers 51*a* to 51*d* (corresponding to transfer portions); an intermediate transfer belt 52 (corresponding to an intermediate transfer member); a driving roller 53; follower rollers 54, 55, and 56; a secondary transfer roller 57; a belt cleaning apparatus 58, and the like. The primary transfer rollers 51*a* to 51*d* make contact with the corresponding photoconductive drums 9 via the intermediate transfer belt 52 formed seamlessly. The primary transfer rollers 51*a* to 51*d* are connected to a transfer voltage applying portion 59 (see FIG. 11) applying a voltage for image transfer, and then transfers a toner image to the intermediate transfer belt 52.

The intermediate transfer belt 52 is laid across the driving roller 53, and the follower rollers 54, 55, and 56 in a tensioned state. The intermediate transfer belt 52 is driven by the driving roller 53 connected to a driving mechanism (not shown) such as a motor, and is rotated around the rollers counterclockwise as seen in the figure. The driving roller 53 makes contact with the secondary transfer roller 57 via the intermediate transfer belt 52, and thereby forms a secondary transfer portion.

Next, how the toner image is transferred to a sheet of paper will be described. A predetermined voltage is applied to the primary transfer rollers 51. Thus, the toner images (each being black, yellow, cyan, and magenta) are sequentially transferred to the intermediate transfer belt 52 as a primary transfer. The toner images are thus primarily transferred at appropriate timing, and are superimposed with no misalignment. A resulting toner image having the four-color toner images laid on one another is then transferred to a sheet by the secondary transfer roller 57 to which a predetermined voltage is being applied. The residual toner particles and the like left on the intermediate transfer belt 52 after the secondary transfer are removed and collected by the belt cleaning apparatus 58 (see FIG. 1).

The fixing apparatus 6 is disposed on a downstream side in a sheet conveyance direction of the secondary transfer roller 57. The fixing apparatus 6 is mainly provided with a fixing roller 61 incorporating a heat source and a pressing roller 62 making press-contact with the fixing roller 61. Between the fixing roller 61 and the pressing roller 62, a nip is formed. When a sheet on which the toner image has been transferred passes through the nip, that sheet is heated and pressed in the nip. As a result, the toner image is fixed onto the sheet. The sheet having the toner image fixed thereon is ejected into the sheet ejected tray 22, and thereby a series of processes for forming an image is completed.

(Configuration for Detecting Electrical Discharge)

Figure 4:
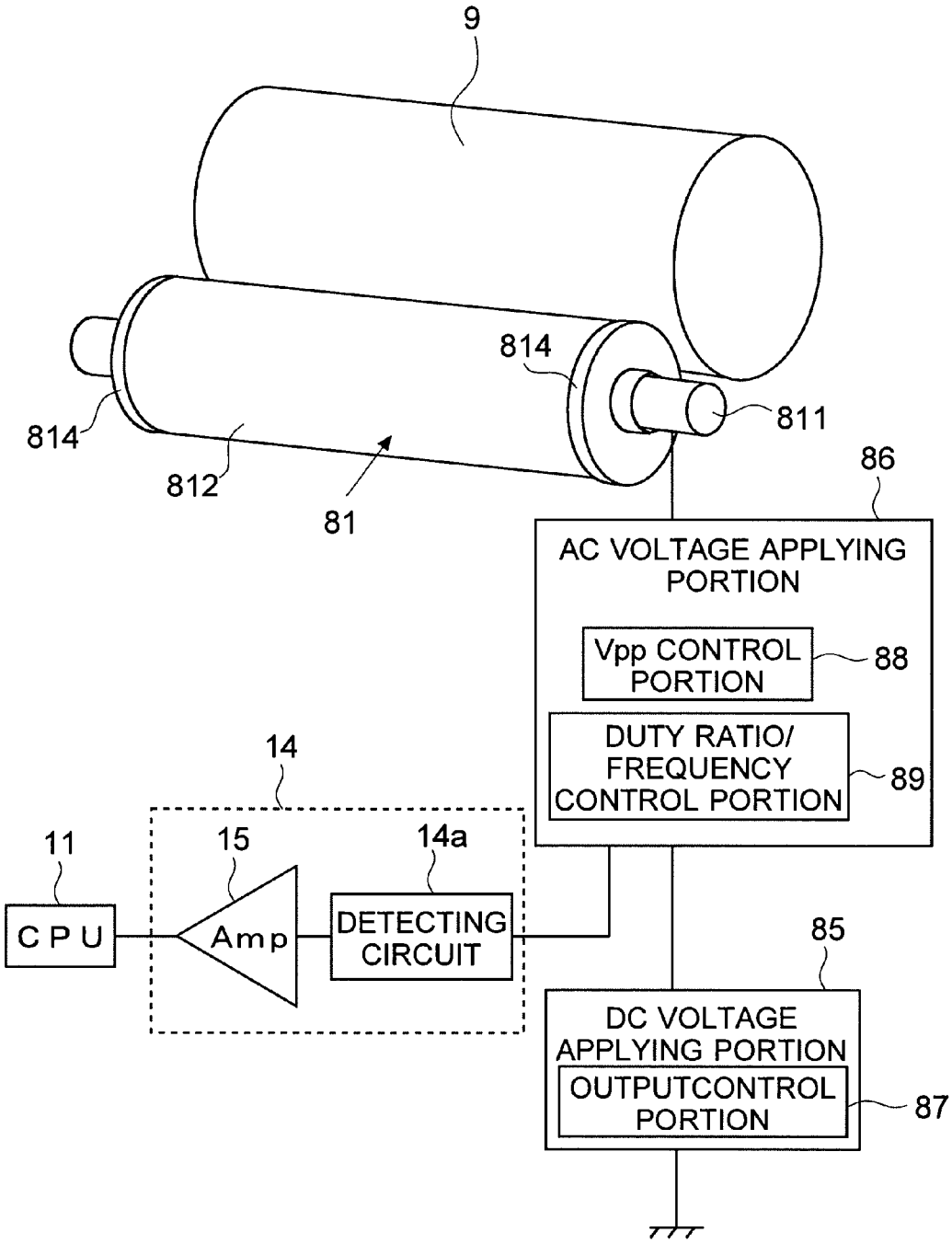
FIG. 4 shows a developing roller and its vicinity working together for applying a developing bias to the developing roller and for detecting electrical discharge between the photoconductive drum and the developing roller.

Next, a configuration for applying a developing bias to the developing rollers 81 and for detecting electrical discharge occurring between the photoconductive drums 9 and the developing rollers 81—both are features of the present invention—will be described with reference to FIG. 4. FIG. 4 shows a configuration illustrating how the developing roller 81 and its vicinity work together in applying a developing bias to the developing roller 81 and in detecting electrical discharge between the photoconductive drum 9 and the developing roller 81 according to the first embodiment of the present invention.

FIG. 4 shows that configuration for one image forming apparatus 3 alone. That is, the image forming portions 3 are each provided with: a DC voltage applying portion 85; an AC voltage applying portion 86; a detecting portion 14; and an amplifier 15. Outputs from the amplifiers 15 are inputted to the CPU 11 inside a control portion 10 which will be described later. Although the DC voltage applying portions 85, the AC voltage applying portions 86, the detecting portions 14, and the amplifiers 15 may be given suffixes a, b, c, and d that represent which of the image forming portions 3 they belong to, constituent elements forming each of the image forming portions 3 are the same, and therefore, they will not be given the suffixes a, b, c, and d in the following description for the purpose of avoiding increased complexity of the description.

As shown in FIG. 4, the developing roller 81 is arranged opposite the photoconductive drum 9 with a gap in between. The developing roller 81 is equipped with: a roller shaft 811; a sleeve 812 carrying the toner particles when engaging in an image forming operation; and caps 814. The roller shaft 811 permits the sleeve 812 to be fitted thereon. Moreover, the round caps 814 are fitted into opposite ends of the sleeve 812. The DC voltage applying portion 85 and the AC voltage applying portion 86 are connected to the roller shaft 811 of the developing roller 81, permitting the toner particles to be supplied to the photoconductive drum 9.

The DC voltage applying portion 85 is a circuit that generates DC components applied to the developing roller 81. An output from the DC voltage applying portion 85 is inputted to the AC voltage applying portion 86. The DC voltage applying portion 85 is provided with an output control portion 87. The output control portion 87 controls, according to an instruction from the CPU 11, a value of a bias that is outputted from the DC voltage applying portion 85.

Figure 5:
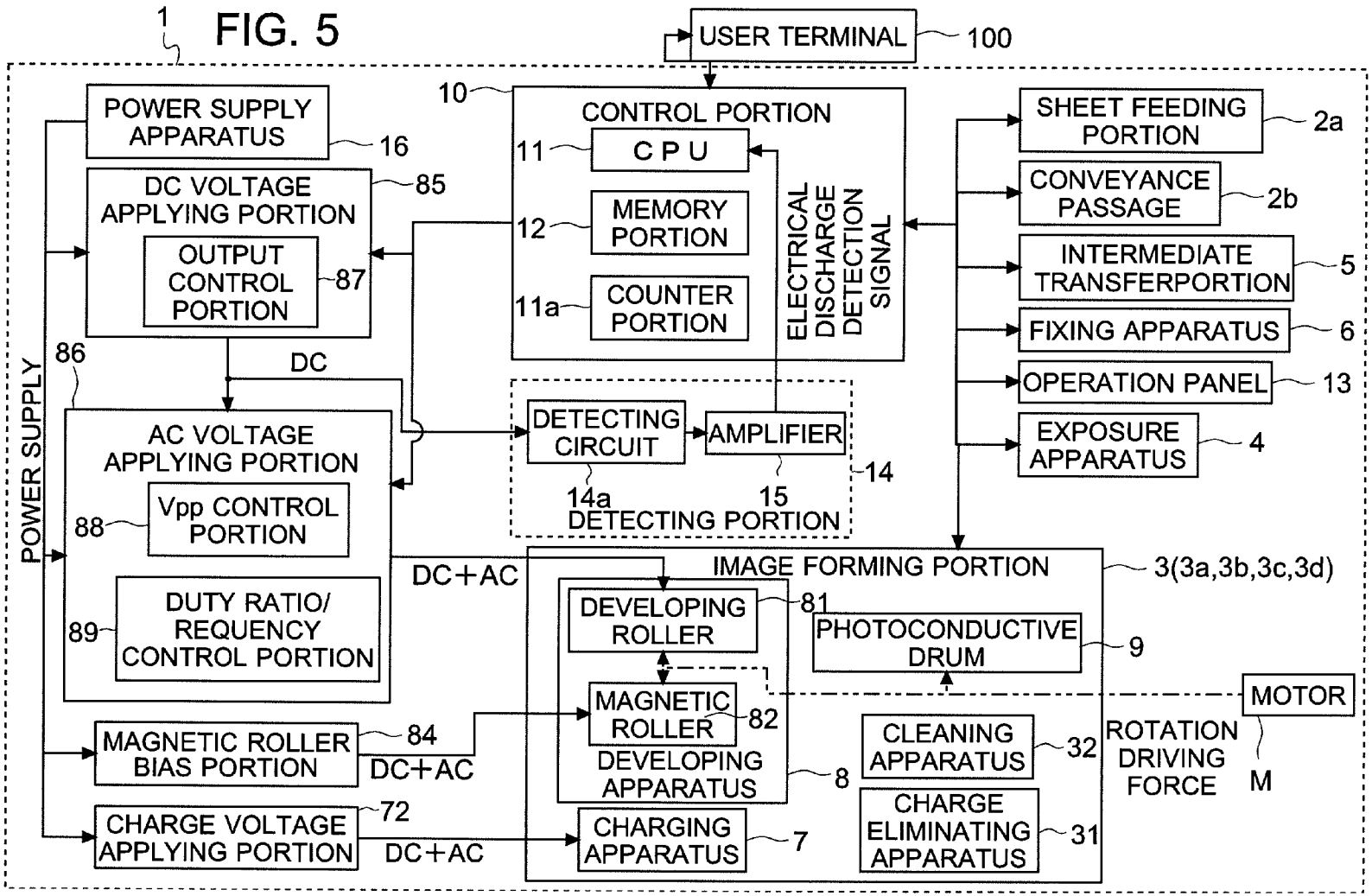
FIG. 5 is a block diagram showing an example of a hardware configuration of the printer according to the first embodiment of the present invention.

The DC voltage applying portion 85 receives a DC power supply from a power supply apparatus 16 inside the printer 1 (see FIG. 5). The DC voltage applying portion 85 is a circuit whose output voltage is varied based on control performed by the output control portion 87 according to the instruction from the CPU 11. For example, the DC voltage applying portion 85 may be a DC-DC converter. Moreover, the DC voltage applying portion 85 may include, for example, an output end thereof to which a plurality of paths extend and through which different output voltages are fed whereby either of the paths is selected for the image forming operation and for an electrical discharge detecting operation. In this way, an AC (alternating) voltage applied to the developing roller 81 is biased.

Moreover, the AC voltage applying portion 86 is, for example, a circuit that outputs an AC (alternating) voltage having a rectangular waveform (in a pulsating shape), and having, as its mean value (equivalent to a center value of its waveform), the DC (direct) voltage outputted from the DC voltage applying portion 85. The AC voltage applying portion 86 is provided with a Vpp control portion 88 and a duty ratio/frequency control portion 89. The Vpp control portion 88 controls a peak-to-peak voltage according to an instruction from the CPU 11. The duty ratio/frequency control portion 89 controls a duty ratio and a frequency of the AC voltage according an instruction from the CPU 11.

For example, the AC voltage applying portion 86 is equipped with a switching element and the like, and outputs the AC voltage whose polarity is reversed by switching between negative and positive polarities. The duty ratio/frequency control portion 89, for example, controls the duty rate and the frequency of the AC voltage by controlling timing at which the AC voltage applying portion 86 switches the output thereof between negative and positive polarities. Moreover, the Vpp control portion 88 performs a buck-boost operation on, namely increases and decreases the DC voltage inputted from the power supply apparatus 16 based on a peak-to-peak voltage of the AC voltage to be applied to the developing roller 81 and the duty ratio. The Vpp control portion 88 varies a peak value on a positive side and a peak value on a negative side of the AC voltage according to the instruction from the CPU 11. A configuration of the AC voltage applying portion 86 and a configuration for varying the peak-to-peak voltage, duty ratio, and frequency of the AC voltage may be what makes it possible to vary the peak-to-peak voltage, the duty ratio, and the frequency.

The AC voltage applying portion 86 includes, in its output stage, a booster circuit formed with a transformer and the like for a boosting purpose. A resulting developing bias boosted thereby and thus having the DC component superimposed on the AC component is applied, for example, to the roller shaft 811 of the developing roller 81. Thus, the developing bias is also applied to the sleeve 812, and thereby the electrically charged toner particles carried by the sleeve 812 are attracted to the photoconductive drum 9.

The detecting portion 14 is provided with a detecting circuit **14*a* and the amplifier 15. The detecting circuit 14*a* converts a current, induced by electrical discharge and passing between the developing roller 81 and the photoconductive drum 9, into a voltage signal, and detects an occurrence of electrical discharge. The amplifier 15 amplifies the converted voltage signal. For example, the detecting circuit 14*a* compares a voltage obtained by converting, using a resistor and the like, a current passing through the developing roller 81 when no electrical discharge occurs, with a voltage obtained by converting a current passing through the developing roller 81 when electrical discharge occurs. The detecting circuit 14*a* outputs a difference between the two different voltages to the amplifier 15. That is, an amount of change in the current passing through the developing roller 81** when electrical discharge occurs is converted into a voltage, and is then outputted. Note that the foregoing configuration is not meant to limit how to convert a current passed owing to electrical discharge into a voltage.

The photoconductive drums 9 used in the printer 1 of this embodiment are each provided with a photoconductive layer formed of amorphous silicon and positively charged. The photoconductive drums 9 have a feature that a large current (high current) induced by electrical discharge is hard to rush therein if the developing roller 81 has a potential higher than the photoconductive drum 9, compared with the photoconductive drum 9 having a higher potential. Thus, to prevent the photoconductive drums 9 from being damaged owing to a large current, the duty ratio and the frequency are adjusted, and electrical discharge is produced with the potential of the developing roller 81 higher (which will be described in detail later). Therefore, a discharge current passes only in a direction from the developing roller 81 to the photoconductive drum 9, and thus, the discharge current can be observed as a change in the DC voltage applied to the developing roller 81.

The detecting portion 14 has simply to focus on the change in the DC voltage of the developing roller 81.

(Hardware Configuration of the Printer 1)

Next, a hardware configuration of the printer 1 according to the first embodiment of the present invention will be described with reference to FIG. 5. FIG. 5 is a block diagram showing an example of a hardware configuration of the printer 1 according to the first embodiment of the present invention.

As shown in FIG. 5, the printer 1 of this embodiment incorporates a control portion 10. The control portion 10 controls each portion forming the printer 1, receives an output from the detecting portion 14, and then recognizes the occurrence of electrical discharge based on it. For example, the control portion 10 is formed with the CPU 11, a memory portion 12, and the like. The CPU 11 is a central processing unit that controls each portion forming the printer 1, and that performs arithmetic operations by executing a control program stored in the memory portion 12. The memory portion 12 is formed with a combination of non-volatile and volatile storage devices, such as ROM, RAM, flash memory, and HDD. For example, the memory portion 12 stores a control program for the printer 1, control data, and the like. Moreover, a counter portion 11*a* counts a time necessary for controlling the printer 1. According to the present invention, the memory portion 12 also stores a program for setting the AC voltages applied for the electrical discharge operation and applied to the developing roller 81.

The control portion 10 is connected to the sheet feeding portion 2*a*, the conveyance passage 2*b*, the image forming portion 3, the exposure apparatus 4, the intermediate transfer portion 5, the fixing apparatus 6, an operation panel 13, and the like. The control portion 10 controls, based on the control data and by executing the control program stored in the memory portion 12, an operation assigned to each portion mentioned above, so that the image forming is appropriately performed. Moreover, the control portion 10 is connected to a motor M, and controls on and off of a power supply to the motor M so as to control a rotation driving force and thus to control rotation of the photoconductive drum 9 and rotation of the developing roller 81, and the like.

The operation panel 13 is disposed, for example, in an upper portion of a front surface thereof, and is formed with a liquid crystal display to display various setting information, a warning, and the like. Moreover, the operation panel 13 is formed with various operation buttons, and receives an operation from user. Moreover, the control portion 10 is connected to a user terminal 100 (such as a personal computer) and the like from which the image data is sent and based on which printing is performed. The control portion 10 performs image processing on that received image data, and then sends resulting image data to the exposure apparatus 4. Based on that image data, the exposure apparatus 4 forms an electrostatic latent image on the photoconductive drum 9. Moreover, a magnetic roller bias applying portion 84 shown in FIG. 5 is a circuit that applies a voltage obtained by superimposing the AC component on the DC component, to the magnetic roller 82. A charge voltage applying portion 72 is a circuit that applies a voltage for charging, to a charging roller 71.

According to the present invention, the control portion 10 (CPU 11) is connected to the detecting portion 14 (amplifier 15). When the electrical discharge detecting operation is performed, the CPU 11 sends, to the AC voltage applying portion 86, an instruction that the peak-to-peak voltage of the AC voltage applied to the developing roller 81 and the like are changed step by step. Then the CPU 11 converts an analog output received from the detecting portion 14 (amplifier 15) on a digital basis. Thus, the CPU 11 detects the occurrence or non-occurrence of electrical discharge, and determines a magnitude of electrical discharge. Then, when the CPU 11 detects the occurrence of electrical discharge, the control portion 10 grasps a difference between the potential of the developing roller 81 and that of the photoconductive drum 9 at a time when electrical discharge occurs, based on the DC voltage and the peak-to-peak voltage value of the AC voltage, etc. at that time. Moreover, the control portion 10 determines a value of the developing bias to be applied for the image forming operation, the value being a largest possible value of all leading to the image forming operation with no electrical discharge. The setting of the developing bias for the image forming operation is stored in the memory portion 12.

(Electrical Discharge Detecting Operation)

Figure 6:
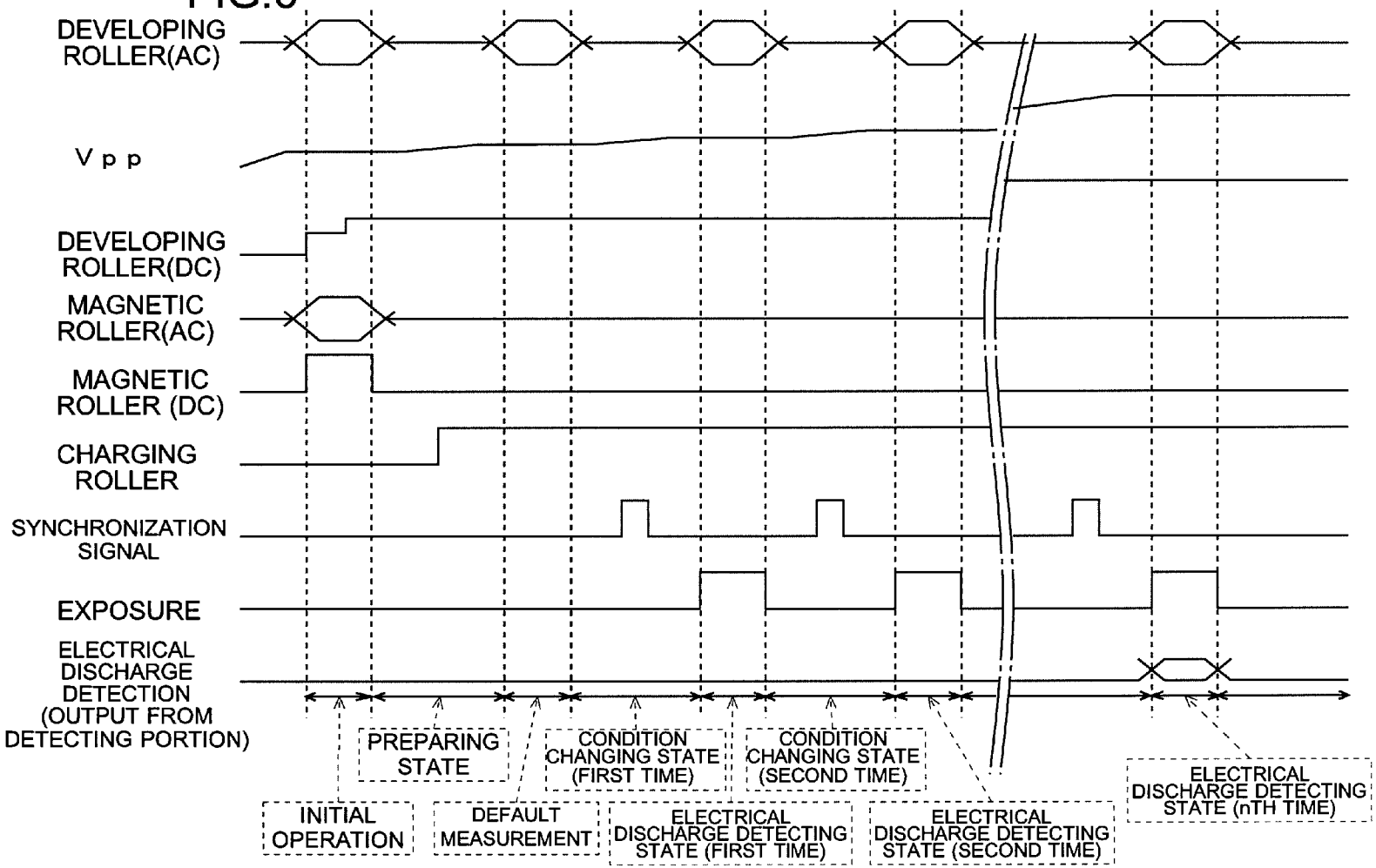
FIG. 6 is a timing chart illustrating an outline of an electrical discharge detecting operation according to the first embodiment of the present invention.

Next, how electrical discharge between the photoconductive drum 9 and the developing roller 81 is detected will be described, as an example, with reference to a timing chart shown in FIG. 6. According to the present invention, the electrical discharge detecting operation is performed to find out a peak-to-peak voltage at which occurrence of electrical discharge is started. FIG. 6 is a timing chart illustrating an outline of the electrical discharge detecting operation according to the first embodiment of the present invention. The electrical discharge detecting operation is carried out for each of the image forming portions 3, one after another.

In FIG. 6, "DEVELOPING ROLLER (AC)" indicates timing at which the AC voltage applying portion 86 applies the AC voltage to the developing roller 81. "Vpp" indicates a change in magnitude of the peak-to-peak voltage of the AC voltage applied to the developing roller 81. "DEVELOPING ROLLER (DC)" indicates timing at which the DC voltage applying portion 85 applies the DC voltage to the developing roller 81. "MAGNETIC ROLLER (AC)" indicates timing at which the magnetic roller bias applying portion 84 applies the AC voltage to the magnetic roller 82. "MAGNETIC ROLLER (DC)" indicates timing at which the magnetic roller bias applying portion 84 applies the DC voltage to the magnetic roller 82.

"CHARGING ROLLER" indicates timing at which the charging apparatus 7 electrically charges the photoconductive drum 9. "SYNCHRONIZATION SIGNAL" depicts a behavior of the synchronization signal outputted from the light receiving element 46 of the exposure apparatus 4. "EXPOSURE" indicates timing at which the exposure apparatus 4 irradiates the photoconductive drum 9 with light (laser beam). "ELECTRICAL DISCHARGE DETECTION (OUTPUT FROM DETECTING PORTION)" indicates timing at which the detecting portion 14 detects the occurrence of electrical discharge.

<Initial Operation>

When the electrical discharge detecting operation is started, an initial operation is carried out first. In the initial operation, the photoconductive drum 9, the developing roller 81, and the intermediate transfer belt 52, and the like start to rotate. Subsequently, the AC and DC voltages are applied to the developing roller 81 and the magnetic roller 82, respectively. By applying the voltage to the magnetic roller 82 in the initial operation, a small amount of the toner particles are supplied from the magnetic roller 82 to the developing roller 81. That is, the magnetic roller 82 supplies the toner to the developing roller 81 before the developing roller 81 receives the AC voltage for the electrical discharge detecting operation. Completion of the initial operation causes the magnetic roller 82 to receive no bias. Basically, in the electrical discharge detecting operation, the developing roller 81 does not carry the toner particles; however, with no toner particles carried on the developing roller 81, a problem emerges such as too great friction between the photoconductive drum 9 and a rotation member (such as the intermediate transfer belt 52) making contact therewith, and therefore, a small amount of toner particles are supplied to the photoconductive drum 9. After the initial operation is completed in this way, a preparing state is entered.

<Preparing State> and <Default Measurement>

When a preparing state is entered, the charging apparatus 7 starts to electrically charge the photoconductive drum 9. A voltage applied to the charging apparatus 7 remains on until an operation for detecting the peak-to-peak voltage at which occurrence of electrical discharge is started is completed. A peak-to-peak voltage of the AC voltage applied to the developing roller 81 is increased to a peak-to-peak voltage in a default measurement. Next, a state in which a default measurement is performed is entered so as to check whether or not electrical discharge is detected. The default measurement is carried out for finding out an error in mounting members and circuits, such as the detecting portion 14, in place. After the default measurement is completed, a condition changing state is entered (first time).

<Condition Changing State>

When a condition changing state is entered, the peak-to-peak voltage of the AC voltage applied to the developing roller 81 is changed step by step (e.g., stepped up). While in the condition changing state, the synchronization signal becomes "High" that serves as a guide for causing the exposure apparatus 4 to start engaging in an exposure operation. After the synchronization signal becomes "High", an electrical discharge detecting state is entered (first time).

<Electrical Discharge Detecting State>

When an electrical discharge detecting state is entered, the developing bias is applied to the developing roller 81, and the exposure apparatus 4 continuously engages in the exposure operation (exposing an entire surface of the photoconductive drum 9 with a surface potential thereof stabilized at 0 V). In the printer 1 of this embodiment, since part exposed to the laser beam is made to carry the toner particles, the continued exposure operation is the same as that for forming an electrostatic latent image of a filled-in image. Thus, in the electrical discharge detecting state, for example, filled-in image data is sent from the control portion 10 to the exposure apparatus 4 (filled-in image data is, for example, stored in the memory portion 12).

The electrical discharge detecting state continues for a predetermined time (e.g., 0.5 seconds to several seconds). Unless there is no input, from the amplifier 15 to the CPU 11, indicating the occurrence of electrical discharge, the control portion 10 enables the condition changing state. In the condition changing state, the control portion 10 sends, to the AC voltage applying portion 86 again, the instruction indicating that the peak-to-peak voltage of the AC voltage is changed. Thus, in a second or later electrical discharge detecting state, the peak-to-peak voltage of the AC voltage applied to the developing roller 81 is basically higher than that of the same voltage applied in a previous state. Until the AC voltage leading to electrical discharge is recognized, the condition changing state and the electrical discharge detecting state are alternately repeated. Meanwhile, the peak-to-peak voltage of the AC voltage applied to the developing roller 81 is increased in predetermined steps. FIG. 6 depicts electrical discharge detected in the nth electrical discharge detecting state.

(Setting the AC Voltage Applied to the Developing Roller 81)

Figure 7:
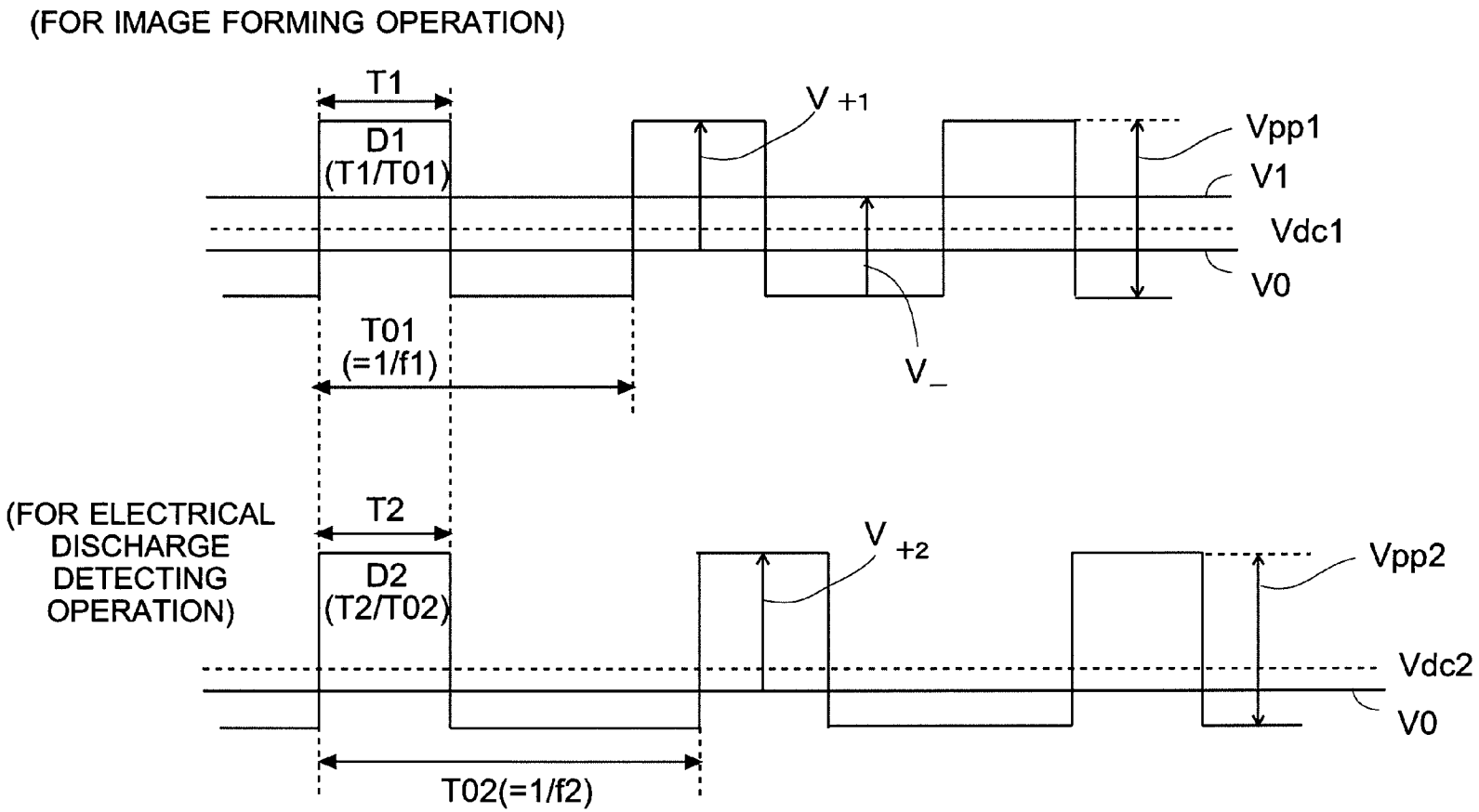
FIG. 7 is a timing chart illustrating in detail an alternating voltage applied to the developing roller according to the first embodiment of the present invention.
Figure 8A:
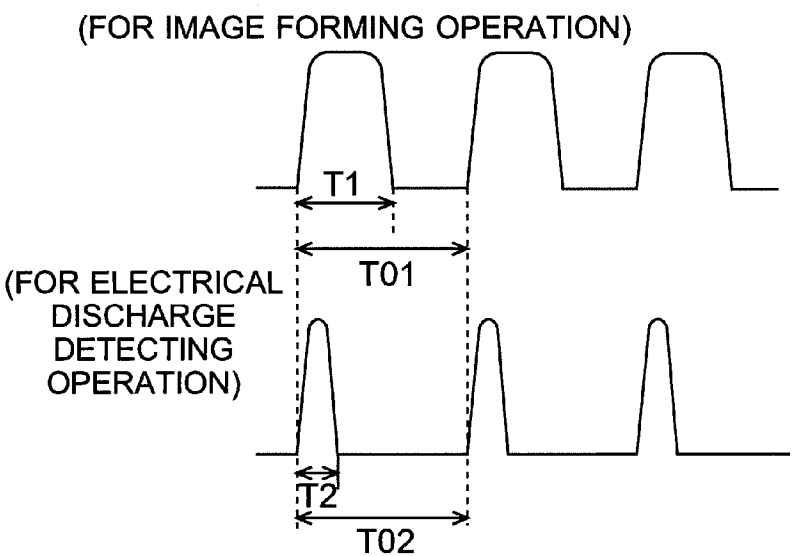
FIGS. 8A and 8B are waveform diagrams showing, by way of example, actual waveforms of the alternating voltage applied to the developing roller according to the first embodiment of the present invention.
Figure 8B:
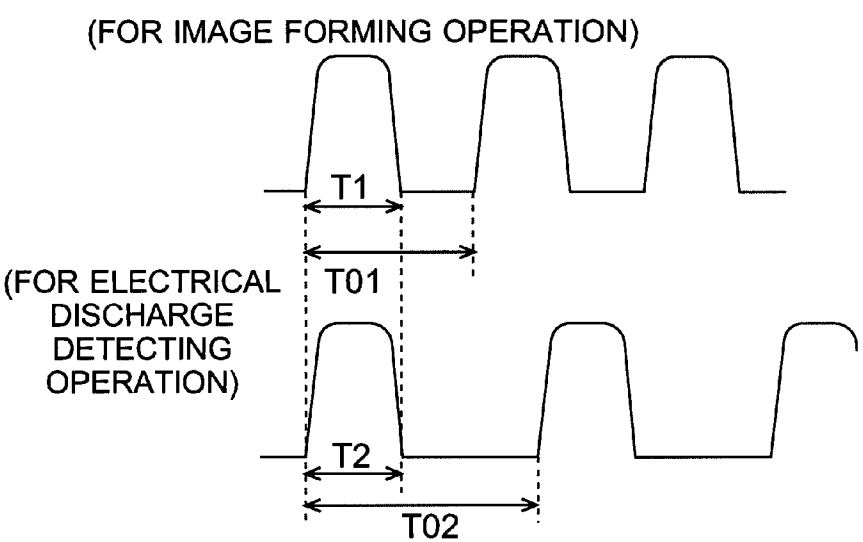

Next, how the AC voltage is applied to the developing roller 81 in the electrical discharge detecting state according to the first embodiment of the present invention will be described with reference to FIGS. 7 and 8. FIG. 7 is a timing chart illustrating in detail the AC voltage applied to the developing roller 81 according to the first embodiment of the present invention. FIGS. 8A and 8B are timing charts each showing a set of waveforms, acquired in practice, of the AC voltage when applied to the developing roller 81 according to the first embodiment of the present invention. In FIGS. 7 and 8, an upper stage depicts a timing chart for the image forming operation, and a lower stage depicts a timing chart for the electrical discharge detecting state.

First, a rectangular waveform depicted in the timing chart for the image forming operation is that, shown by way of example, of the developing bias (DC+AC) applied to the developing roller 81. In the figure, "Vdc1" indicates a potential of a bias of the DC voltage applying portion 85. "V0" indicates a potential of the photoconductive drum 9 after it is exposed to the laser beam by the exposure apparatus 4 (approximately 0 V="light" potential). "V1" indicates a potential of the photoconductive drum 9 after it is electrically charged (potential of part not exposed to light, in a range, for example, of approximately 200 V to 300 V). "$V_{+1}$," indicates a potential difference between V0 and a positive peak value of the developing bias for the image forming operation. "V−" indicates a potential difference between V1 and a negative peak value of the developing bias. "Vpp1" indicates a peak-to-peak voltage of the AC voltage applied to the developing roller 81 for the image forming operation. "T1" indicates a "High" period (in a positive polarity state) of the rectangular waveform. "T01" indicates a cycle of the rectangular waveform.

On the other hand, a rectangular waveform depicted in the timing chart for the electrical discharge detecting state is that of the developing bias applied to the developing roller 81 in the electrical discharge detecting state. "Vdc2" indicates a potential of a bias of the DC voltage applying portion 85 in the electrical discharge detecting state. "V0" indicates, as in the upper stage of FIG. 7, a potential of the photoconductive drum 9 after it is exposed to the laser beam by the exposure apparatus 4 (approximately 0 V). "$V_{+2}$" indicates a potential difference between a peak value of the AC voltage applied to the developing roller 81 for the electrical discharge detecting operation and V0. "Vpp2" indicates a peak-to-peak voltage of the AC voltage applied to the developing roller for the electrical discharge detecting operation. "T2" indicates a "High" period (in a positive polarity state) of the rectangular waveform. "T02" indicates a cycle of the rectangular wave.

First, when the electrical discharge detecting operation is performed, the output control portion 87 sets, according to an instruction from the control portion 10, an output of the DC voltage applying portion 85 to a setup value Vdc2 (e.g., 100 V to 200 V) for the electrical discharge detecting operation. The Vpp control portion 88 sets, according to an instruction from the control portion 10, an AC voltage Vpp2 outputted by the AC voltage applying portion 86. The duty ratio/frequency control portion 89 sets, according to an instruction from the control portion 10, a duty ratio D2 (ratio of the "High" period T2 to the cycle T02 as expressed by T2/T02) of the AC voltage outputted from the AC voltage applying portion 86 to a setup value for the electrical discharge detecting operation. Moreover, the duty ratio/frequency control portion 89 sets the frequency f2 (=1/T02) of the AC voltage outputted from the AC voltage applying portion 86 to a setup value for the electrical discharge detecting operation (in the lower stage of FIG. 7).

Here, the duty ratio D2 is set lower than a duty ratio D1 (ratio of the "High" period to the cycle T01 as expressed by T1/T01) for the image forming operation (e.g., D1=40%, D2=30%). Moreover, a center value (mean value) of one cycle of the AC voltage (rectangular waveform) is used as setup values of the DC bias (represented by Vdc1 for the image forming operation, and by Vdc2 for the electrical discharge detecting operation in the figure). Then, the duty ratio of the AC voltage for the electrical discharge detecting operation is made smaller than that for the image forming operation. Thus, a difference between the peak value on the positive side of the AC voltage and the center value, namely the setup value Vdc2 for the DC bias can be made large. Moreover, with the duty ratio smaller than that for the image forming operation, even if the peak-to-peak voltage is increased, an absolute value of the potential on the negative side is hard to be greater than that on the positive side. Accordingly, the potential difference $V_{+2}$ between the peak value on the positive side of the AC voltage and the light potential V0 (approximately 0 V) of the photoconductive drum 9 surface can be made larger than that between the peak value on the negative side and the light potential V0 (see the lower stage of FIG. 7). Thus, electrical discharge can be produced between the developing roller 81 and the photoconductive drum 9 with the potential of the developing roller 81 higher than that of the photoconductive drum 9.

Moreover, the photoconductive drum 9 of this embodiment is formed with a photoconductive layer formed of amorphous silicon and positively charged. With the photoconductive drum 9 so formed, electrical discharge current is not dramatically increased if the potential of the developing roller 81 is higher than that of the photoconductive drum 9. That is, it is verified that the photoconductive drum 9 exhibits a feature that a large current is hard to rush therein as compared with a case where electrical discharge occurs with the potential of the developing roller 81 lower than that of the photoconductive drum 9. This helps eliminate damage to the photoconductive drum 9, such as a pinhole made in the photoconductive drum 9, owing to a large current passing through the photoconductive drum 9. Moreover, even if electrical discharge is repeatedly produced, there is no damage to the photoconductive drum 9, making it possible to frequently carry out the operation for detecting the peak-to-peak voltage at which the occurrence of electrical discharge is started. Thus, the printer 1 can maintain its high developing efficiency.

In practice, the AC voltage is applied to the toner particles adhering to the developing roller 81 and to the developer, etc., serving as capacitive load, between the developing roller 81 and the magnetic roller 82. Thus, the AC voltage, in practice, takes a certain time in rising and falling, and exhibits a rather unsharpened waveform. For example, as shown in FIG. 8A, when the cycle of the AC voltage remains the same as that for the image forming operation (T01=T02), if the duty ratio D2 is made smaller than the duty ratio D1 for the image forming operation, the AC voltage results in the "High" period shorter than that for the image forming operation.

Thus, in this embodiment, as shown in FIG. 8B, the frequency f2 is set so that the period on the positive side of the AC voltage for the image forming operation becomes equal to that for the electrical discharge detecting operation (T1=T2) (e.g., suppose D1 is 40%, and D2 is 30%, if the frequency f1 for the image forming operation is 4 kHz, f2 results in 3 kHz). Whether or not electrical discharge occurs depends on a period of the peak value of the AC voltage applied to the developing roller 81; therefore, in this embodiment, the period for which the AC voltage for the electrical discharge detecting operation remains on the positive side can be secured to be equal to that for the image forming operation. That is, the state of the AC voltage being applied for detecting a peak-to-peak voltage at which the occurrence of electrical discharge is started is matched with that for the image forming operation.

The setup value Vdc2 of the bias for the electrical discharge detecting operation is set higher than the setup value Vdc1 of the bias for the image forming operation. Thus, the toner particles are charged positively, and the amount of the toner particles can be reduced that are supplied from the magnetic roller 82 to the developing roller 81 when the electrical discharge detecting operation is performed.

(Procedure for Controlling the Electrical Discharge Detecting Operation)

Figure 9:
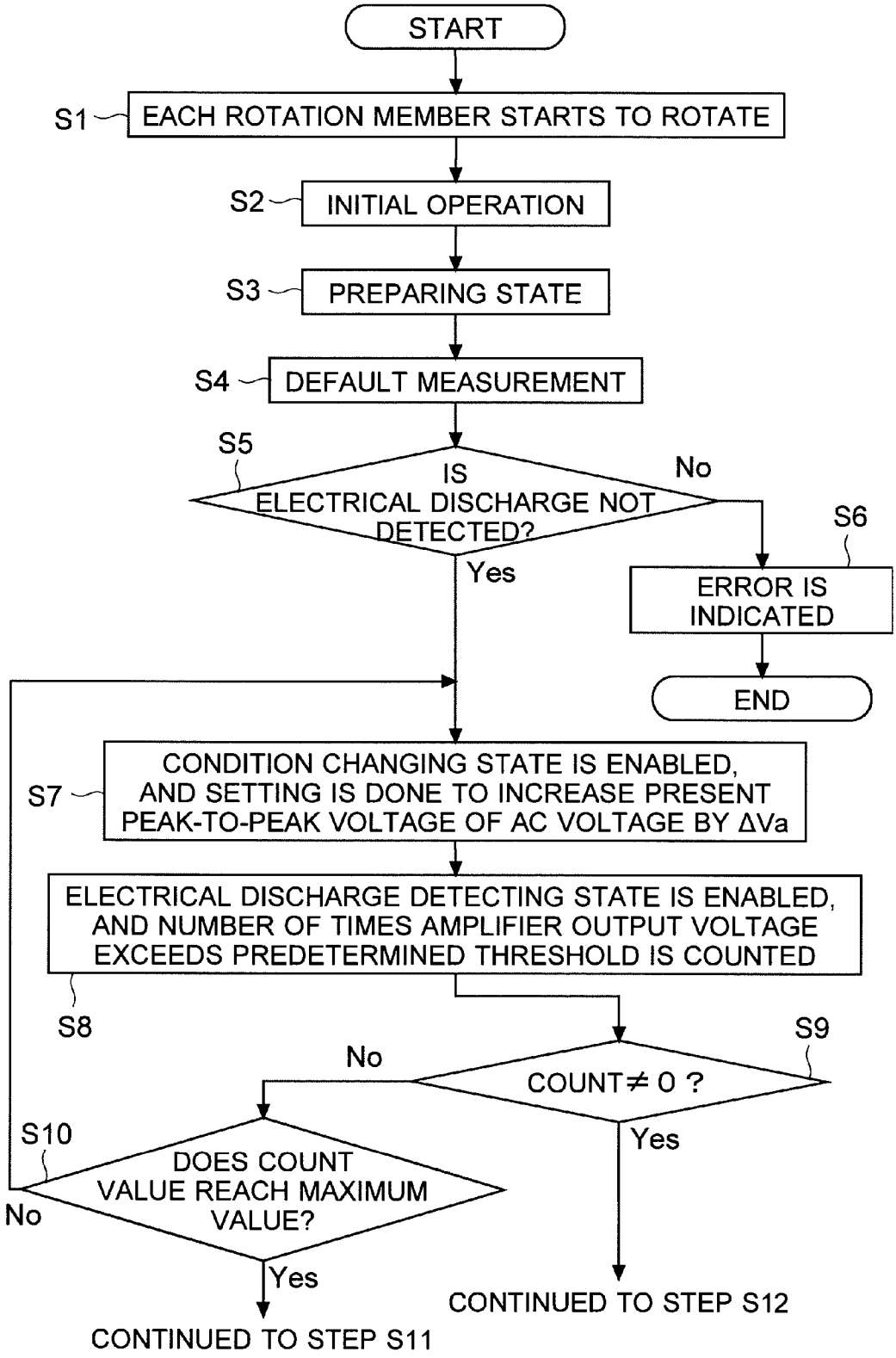
FIG. 9 is a flow chart depicting, as an example, a series of steps involved in controlling the electrical discharge detecting operation performed by the printer according to the first embodiment of the present invention.
Figure 10:
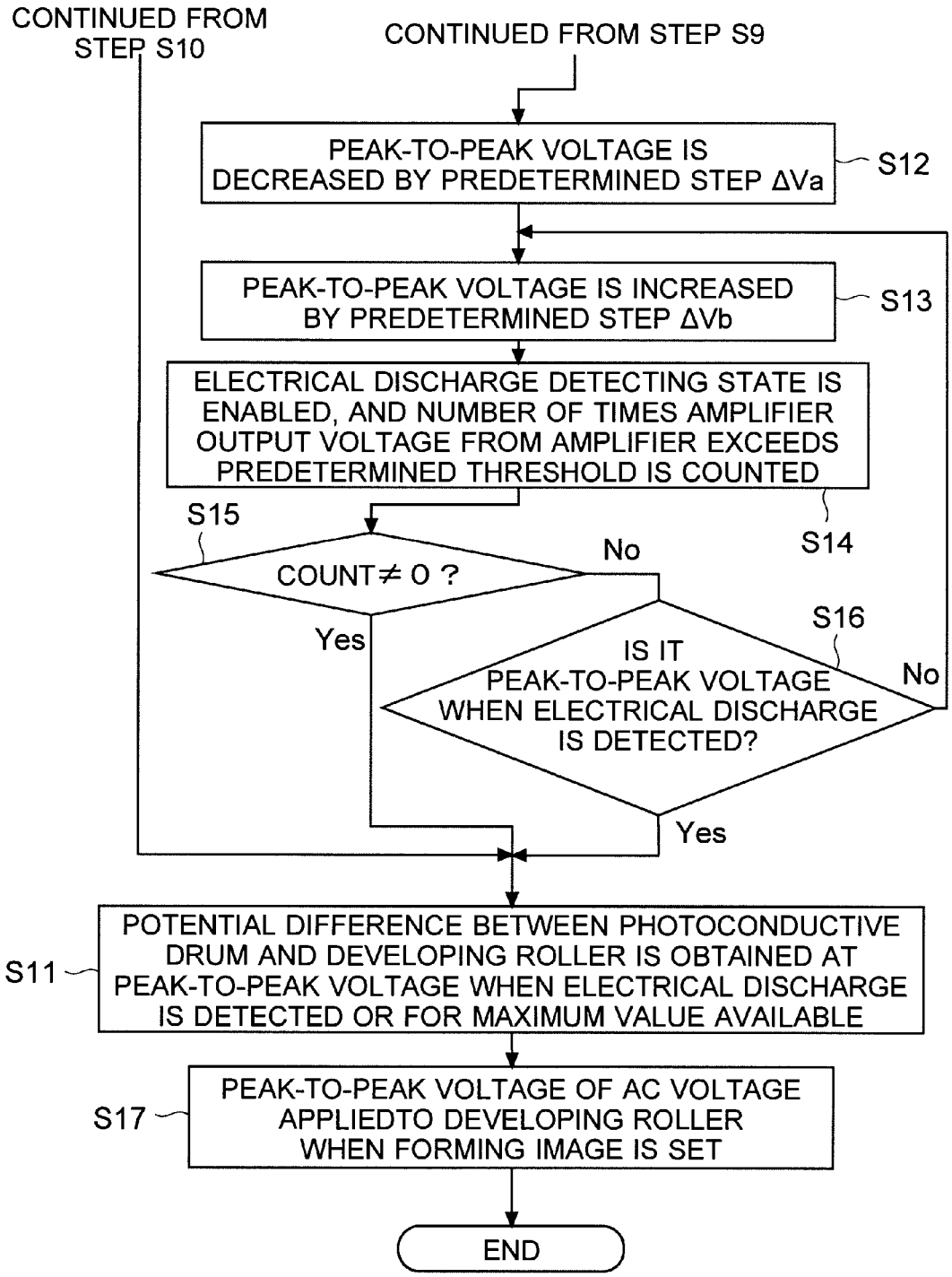
FIG. 10 is a flow chart, continued from FIG. 9, depicting, as an example, the series of steps involved in controlling the electrical discharge detecting operation performed by the printer according to the first embodiment of the present invention.

Next, a series of steps involved in controlling the electrical discharge detecting operation performed by the printer 1 according to the first embodiment of the present invention to detect a peak-to-peak voltage at which the occurrence of electrical discharge is stated will be described as an example with reference to FIGS. 9 and 10. FIGS. 9 and 10 together depict a flow chart illustrating by way of example a procedure for controlling the electrical discharge detecting operation performed by the printer 1 according to the first embodiment of the present invention; the chart is divided into two sections depicted in FIGS. 9 and 10, respectively. The flow chart depicts control performed on one image forming apparatus 3 alone; therefore, the control is in practice performed four times for the four colors.

A series of operations performed in detecting the occurrence of electrical discharge, including intentionally producing electrical discharge, for the purpose of grasping a peak-to-peak voltage at which the occurrence of electrical discharge is started can also be performed in finding out an initial failure or in carrying out an initial setting during manufacture, when the printer 1 is installed, or when the developing apparatus 8 or the photoconductive drum 9 is replaced. Specifically, the series of operations is performed when the printer 1 is installed because the atmospheric pressure varies according to the altitude of the environment where the printer 1 is installed (e.g., between a plain area in Japan and a high land in Mexico), and thus, the voltage at which the occurrence of electrical discharge is started varies accordingly. Moreover, it is performed when the developing apparatus 8, etc. is replaced because the gap between the photoconductive drum 9 and the developing roller 81 is altered from the gap before they are replaced. The timing at which the electrical discharge detecting operation is performed is not limited to those mentioned above, and may be appropriately set; for example, it may be performed each time when the printer 1 prints a predetermined number of sheets.

When the electrical discharge detecting operation is started (START) through a predetermined operation using the operation panel 13, etc., each portion forming the image forming portion 3, such as the photoconductive drum 9, the developing roller 81 and the magnetic roller 82, and each rotating member forming the intermediate transfer portion 5, such as the intermediate transfer belt 52, start to be rotated by the unillustrated driving mechanism according to an instruction from the CPU 11 (control portion 10) (step S1). The driving of each rotation member is continued until the operation for detecting the peak-to-peak voltage at which the occurrence of electrical discharge is started is completed. Note that in the operation for detecting the peak-to-peak voltage at which the occurrence of electrical discharge is started, the developing roller 81 basically carries no toner particles. Subsequently, the initial operation described with reference to FIG. 6 is performed (step S2). Then, the preparing state described with reference to FIG. 6 is enabled (step S3). For example, in step S3, the charge voltage applying portion 72 starts applying the voltage to the charging apparatus 7 according to an instruction from the CPU 11.

Subsequently, the default measurement described with reference to FIG. 6 is performed (step S4). At that time, it is confirmed that no electrical discharge is detected (step S5). The default measurement is performed under conditions that electrical discharge will never occur (e.g., when, the AC voltage having the lowest peak-to-peak voltage, among all the AC voltages available, is applied to the developing roller 81, when no exposure is performed, or the like), and if the occurrence of electrical discharge is detected in the default measurement (No in step S5), the gap and/or hardware such as the detecting portion 14 may be considered to be in an abnormal state. In that case, error indication is performed by the operation panel 13 and the like (step S6), and then the electrical discharge detecting operation is completed (END).

On the other hand, the CPU 11, if receiving no such a signal (electrical discharge detection signal) indicating the occurrence of electrical discharge (Yes in Step S5), then enables the condition changing state described with reference to FIG. 6, and then, the control portion 10 (CPU 11) proceeds with the sending of instructions. Accordingly, setting is performed so that the Vpp control portion 88 increases a present peak-to-peal voltage of the AC voltage outputted from the AC voltage applying portion 86 by a predetermined step ΔVa (e.g., step may vary from 30 V to 100 V) (step S7).

Subsequently, the electrical discharge detecting state is entered. Specifically, the AC voltage whose peak-to-peak voltage is increased by ΔVa from the previously applied AC voltage is applied to the developing roller 81 in the next electrical discharge detecting state. In addition, the exposure is performed for a predetermined time according to an instruction from the control portion 10 (CPU 11), and the CPU 11 counts how many times an output voltage of the amplifier 15 exceeds a predetermined threshold (step S8). Then, it is checked that a resulting count value is not zero (step S9).

If the count value is zero (No in step S9), the control portion 10 (CPU 11) considers it as the non-occurrence of electrical discharge, and then checks whether or not the present peak-to-peak voltage reaches the maximum value available (e.g., 1500 V to 3000 V) (step S10). Then, if the maximum value is reached (Yes in step S10), the ongoing process proceeds to step S11 shown in FIG. 10 (as will be described in detail later). Otherwise (No in step S10), the ongoing process returns to step S7.

In step S9, if the count value is 1 or more (Yes in step S9), the control portion 10 (CPU 11) considers it as the occurrence of electrical discharge, and then sends an instruction to the Vpp control portion 88. Based on that instruction, the Vpp control portion 88 performs setting whereby the peak-to-peak voltage of the AC voltage applied to the developing roller 81 is decreased by the predetermined step ΔVa (step S12). Moreover, the Vpp control portion 88 sets the peak-to-peak voltage of the AC voltage applied to the developing roller 81 to a value increased by a predetermined step ΔVb (step S13). Here, it can be assumed that the predetermined step ΔVb is obtained by dividing the predetermined step ΔVa (e.g., if ΔVa is 50 V, then the step ΔVb is 10 V). In other words, to increase accuracy in finding out a peak-to-peak voltage at which the occurrence of electrical discharge is started, the peak-to-peak voltage of the AC voltage is decreased by the step ΔVa once, down to a previous value, and is in turn changed in steps smaller than the steps ΔVa.

Subsequently, when the electrical discharge detecting state is enabled as in step S8, and the control portion 10 (CPU 11) counts the number of times the output voltage of the amplifier 15 exceeds a predetermined threshold (step S14). In other words, the peak-to-peak voltage is changed in steps ΔVa first. Then, if electrical discharge is detected, the step ΔVb is in turn used to thereby obtain, with increased accuracy, the peak-to-peak voltage at which the occurrence of electrical discharge is started while the electrical discharge detecting state and the condition changing state are alternately enabled until electrical discharge is detected.

Subsequently, the control portion 10 checks that the resulting count value is not zero (step S15). If the resulting count value is zero (No in step S15), the control portion 10 (CPU 11) considers it as the non-occurrence of electrical discharge, and then checks whether or not a present peak-to-peak voltage reaches the peak-to-peak voltage at which the occurrence of electrical discharge is detected (step S16). Then, if it reaches the peak-to-peak voltage with the occurrence of electrical discharge (Yes in step S16), the ongoing process proceeds to step S11. Otherwise, namely if it does not reach that peak-to-peak voltage with the occurrence of electrical discharge (No in step S16), the ongoing process returns to step S13. On the other hand, if the resulting count value is 1 or more (Yes in step S15), the CPU 11 recognizes electrical discharge occurring with the present peak-to-peak voltage, and the ongoing process proceeds to step S11.

Next, an operation performed in step S11 will be described in detail. When electrical discharge is detected (when Yes is returned in step S15, and when Yes is returned in step S16), or when no electrical discharge is detected at the maximum peak-to-peak voltage available (when Yes is returned in step S10), the control portion 10 (CPU 11) obtains the potential difference $V_{+2}$ shown in FIG. 7 from the maximum peak-to-peak voltage or the peak-to-peak voltage Vpp2 at a time when electrical discharge has occurred, the frequency f2, the duty ratio D2, and the bias setup value Vdc2 (step S11). That is, a potential difference between the photoconductive drum 9 and the developing roller 81 when electrical discharge is detected or when the voltage Vpp 2 having the maximum value available is applied.

The potential difference $V_{+2}$ is obtained easily. The CPU 11 specifies the magnitude of the peak-to-peak voltage, and then sends an instruction to the Vpp control portion 88. This means that the control portion 10 already grasps Vpp2 when electrical discharge is detected. Assuming that the area on the positive side of the rectangular waveform is made equal to the area on the negative side with both the setup values of D2 and Vdc2 serving as reference values, a potential difference between a peak value on the positive side of Vpp2 and Vdc2 is obtained. A value thus obtained is then added to a potential difference between Vdc2 and V0 to obtain $V_{+2}$. Note that V0 is approximately 0 V, and thus simply Vdc2 will do.

Specifically, when the electrical discharge detecting operation is performed, Vpp2 is changed step by step. Suppose that the duty ratio D2 and the bias setup value Vdc2 are constant, $V_{+2}$ can be obtained in advance according to the magnitude of Vpp2. Then, values of $V_{+2}$ obtained according to the magnitude of Vpp2 are put into a lookup table as data. This table may be stored, for example, in the memory portion 12, and may be referenced by the CPU 11 to obtain $V_{+2}$.

Subsequently, based on $V_{+2}$ thus obtained, the control portion 10 (CPU 11) sets the peak-to-peak voltage Vpp1 of the AC voltage applied to the developing roller 81 for the image forming operation, so that both $V_{+1}$ and V− shown in FIG. 7 are smaller than $V_{+2}$ (step S17). The peak-to-peak voltage Vpp1 can be determined in various ways; for example, it may be obtained by arithmetic operations. However, there are various factors to be considered; for example, to prevent electrical discharge, how much $V_{+1}$ and V− are decreased compared with $V_{+2}$ (how much a margin needs to be) depends on the kind of toner used. Thus, based on a result of an experiment conducted in a development phase, for example for the calculated values of $V_{+2}$, values of Vpp1 considered to induce no electrical discharge when the image forming operation is performed are put into a table. Then, the control portion 10 (CPU 11) may reference that table to thereby determine Vpp1. This table may also be stored in the memory portion 12. Thus, an AC voltage that is as high as possible and that leads to no electrical discharge can be applied when the image forming operation is performed.

As described above, in this embodiment, to grasp the peak-to-peak voltage (potential difference between the developing roller 81 and the photoconductive roller 9) at which the occurrence of electrical discharge is started, electrical discharge is intentionally produced by changing the AC voltage applied to the developing roller 81. Here, regarding an increase in the potential difference between the photoconductive drum 9 and the developing roller 81, a direction in which an increase in current induced by electrical discharge is smaller is grasped in advance. And when the electrical discharge detecting operation is performed, the AC voltage applying portion 86 applies, to the developing roller 81, the AC voltage whose frequency and duty ratio are different from those for the image forming operation, so that electrical discharge occurs in the direction in which an increase in the current induced by electrical discharge is smaller. That is, by changing the duty ratio of the AC voltage, a direction in which a discharge current passes is controlled. Thus, electrical discharge is produced in the direction in which an increase in the current induced by electrical discharge is smaller, so that the photoconductive drum 9 is prevented from being damaged.

For example, among various kinds of the photoconductive drums 9 having a photoconductive layer formed of amorphous silicon and positively charged, there is one kind of the photoconductive drum 9 through which the current abruptly induced by electrical discharge does not pass if the potential of the developing roller 81 is higher than that of the photoconductive drum 9, as compared with the potential of the developing roller 81 lower than that of the photoconductive drum 9. In this case, by making a duty ratio different from that for the image forming operation, electrical discharge can be intentionally produced between the developing roller 81 and the photoconductive drum 9 with the potential of the developing roller 81 higher than that of the photoconductive drum 9. Thus, the photoconductive drum 9 is little damaged as a result of electrical discharge produced for the purpose of grasping the peak-to-peak voltage at which the occurrence of electrical discharge is started. That is, it is possible to reduce damage to the photoconductive drum 9, and to measure a potential difference between the photoconductive drum 9 and the developing roller 81 leading to electrical discharge.

In a case where the photoconductive drum 9 having a photoconductive layer formed of amorphous silicon and positively charged is employed, the AC voltage applying portion 86 applies, to the developing roller 81 for the electrical discharge detecting operation, the AC voltage having the duty ratio and the frequency smaller than the AC voltage applied for the image forming operation, the frequency being set smaller so that a period on a positive side of the AC voltage becomes equal to a period on the positive side of the AC voltage applied for the image forming operation. Thus, even if the AC voltage takes time in rising and falling, the AC-voltage-positive period can be secured to be as long as for the image forming operation. Accordingly, the state of the AC voltage being applied for the electrical discharge detecting operation is matched with that for the image forming operation.

In this embodiment, the magnetic roller 82 is arranged opposite the developing roller 81, and carries the positively charged toner particles. When the electrical discharge detecting operation is performed, the control portion 10 enables the DC voltage applying portion 85 to apply, to the developing roller 81, a DC voltage higher than the DC voltage applied for the image forming operation. Accordingly, the toner particles charged positively are hard to be supplied from the magnetic roller 82 to the developing roller 81 for the electrical discharge detecting operation. Thus, even if the developing bias is applied to the developing roller 81, no toner particles are attracted to the photoconductive drum 9. That is, no toner particles are consumed in waste. Moreover, there is no movement in electrical charges, which would otherwise take place with the positively charged toner particles adhering to the photoconductive drum 9. This helps reduce an error in detecting electrical discharge.

If the occurrence of the electrical discharge is detected when the electrical discharge detecting operation is performed, the control portion 10 obtains a potential difference between the photoconductive drum 9 and the developing roller 81 at a peak value of the AC voltage applied to the developing roller 81 when the electrical discharge has occurred, and then determines an AC voltage to be applied to the developing roller 81 for the image forming operation, so that a surface potential difference between the photoconductive drum 9 and the developing roller 81 for the image forming operation becomes smaller than the potential difference thus obtained. Thus, based on the potential difference between the developing roller 81 and the photoconductive drum 9, as grasped with accuracy, starting electrical discharge, it is possible to appropriately set an AC voltage leading to the image forming operation with an increased developing efficiency and with no electrical discharge.

Although the first embodiment describes an example in which a predetermined threshold (absolute threshold) having a certain fixed value, the electrical discharge detecting operation may be performed using a relative threshold (rate of change in voltage value). That is, the control portion 10 monitors a change in a signal received from the detecting portion 14, and (e.g., the CPU 11) calculates a rate of change in the voltage value indicated by the electrical discharge detection signal, and the threshold is provided for the rate of the change in the voltage value indicated by the electrical discharge detection signal.

For example, connected to the DC voltage applying portion 85 or the AC voltage applying portion 86 for the electrical discharge detecting operation, the detecting circuit 14*a* may possibly be affected by noise such as electromagnetic wave produced by the DC voltage applying portion 85, the AC voltage applying portion 86, and the other voltage applying portion. Moreover, the detecting circuit 14*a*, depending on how it is configured, may become susceptible to noise. Due to these factors, certain degrees of voltage may be imposed on a signal line extending from the detecting portion 14 to the control portion 10, and moreover, that voltage may be varied (not stabilized). In either case, the use of a relative threshold may make it easy to detect the occurrence of electrical discharge. That is, when current is induced by electrical discharge, and a significant change is observed in a state of the signal line extending from the detecting portion 14 to the control portion 10, the control portion 10 considers it as the occurrence of electrical discharge. Thus, the control portion 10 may be able to detect the occurrence of electrical discharge correctly.

Second Embodiment

Figure 11A:
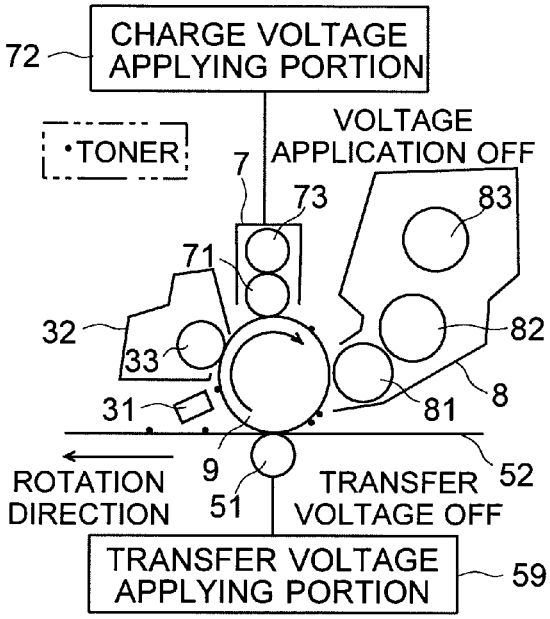
FIG. 11A is a partially enlarged view of an image forming portion 3 engaging in the electrical discharge detecting operation.
Figure 11B:
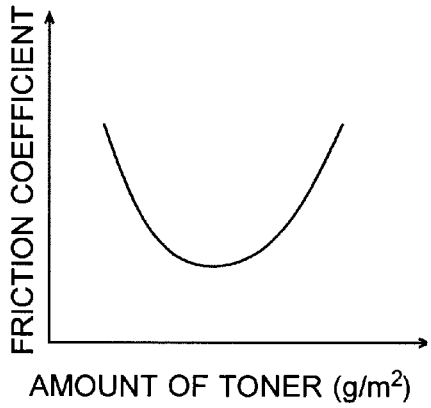
FIG. 11B is a graph showing, by way of example, a relationship of a change in a friction coefficient of an intermediate transfer belt versus an amount of toner particles adhering to the intermediate transfer belt.
Figure 11C:
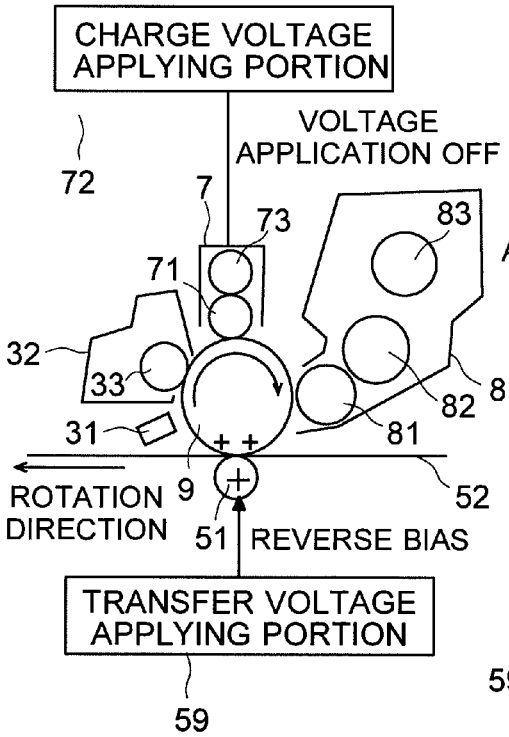
FIG. 11C is a partially enlarged view of the image forming portion engaging in the electrical discharge detecting operation.
Figure 11D:
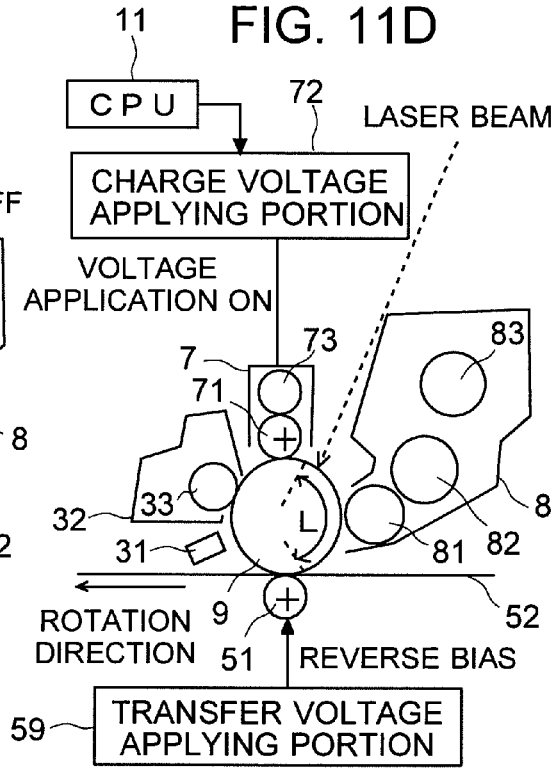
FIG. 11D is a partially enlarged view of the image forming portion engaging in the electrical discharge detecting operation according to a second embodiment of the present invention.

Next, a printer 1 according to a second embodiment of the present invention will be described with reference to FIG. 11A to 11D. FIG. 11A is a partially enlarged view of the image forming portion 3 when engaging in the electrical discharge detecting operation. FIG. 11B is a graph showing, by way of example, a relationship of change in friction coefficient of the intermediate transfer belt 52 versus an amount of toner particles adhering to the intermediate transfer belt 52. FIG. 11C is another partially enlarged view of the image forming portion 3 when engaging in the electrical discharge detecting operation. FIG. 11D is yet another partially enlarged view of the image forming portion 3 when engaging in the electrical discharge detecting operation according to the second embodiment of the present invention.

A printer 1 of this embodiment may be the same as the printer 1 of the first embodiment. For example, what is described with reference to FIGS. 1 to 10 is applied to the second embodiment. Thus, in the following description and drawings, no overlapping description of the same parts as in the first embodiment will be repeated unless necessary.

First, FIG. 11A will be described. FIG. 11A illustrates, as an example, how voltages are applied in the image forming portion 3 when engaging in the electrical discharge detecting operation (while in the electrical discharge detecting state). FIG. 11A depicts no voltage for electrically charging applied to the charging apparatus 7 and the transfer roller 51.

When the electrical discharge detecting operation is performed, if the potential of the photoconductive drum 9 is not stabilized, electrical discharge may be produced in one case, and may not be in the other case, with the same developing bias applied. This leads to decreased accuracy in setting the peak-to-peak voltage Vpp1 of the AC voltage for the image forming operation. Moreover, setting the peak-to-peak voltage Vpp1 of the AC voltage to a value for the image forming operation may possibly lead to the occurrence of electrical discharge.

Thus, a method is proposed according to which no voltage is applied to the charging apparatus 7 and the primary transfer roller 51 when the electrical discharge detecting operation is performed, as shown in FIG. 11A, so that a surface potential of the photoconductive drum 9 is stabilized. With this, the potential of the photoconductive drum 9 is stabilized at approximately zero (a ground level). Here, basically in the printer 1 of this embodiment, the developing roller 81, when engaging in the electrical discharge detecting operation, is made to carry no toner particles. Specifically, when a positive voltage is applied to the magnetic roller 82, the toner particles, bearing electrical charges with a positive polarity, are moved from the magnetic roller 82 to the developing roller 81, owing to a repulsive force exerted between the toner particles and the magnetic roller 82. Accordingly, so long as the magnetic roller 82 receives no voltage, no toner particles thereon are moved toward the developing roller 81.

However, there is a certain amount of toner particles left on the surface of the photoconductive drum 9. Moreover, since some toner particles are dragged as the sleeve 812 rotates, etc, the amount of toner particles carried by the sleeve 812 is not reduced to zero. Thus, there is a possibility that the toner particles left on the developing roller 81 are attracted to the photoconductive drum 9. If that happens, since the potential of the intermediate transfer belt 52 is lower than that of the toner particles, there are some toner particles observed, as shown in FIG. 11A, that move onto the intermediate transfer belt 52. Thus, during the electrical discharge detecting operation, the toner particles continue to move little by little onto the intermediate transfer belt 52.

On the other hand, as shown in FIG. 11B as an example, there is a problem that a friction coefficient of the intermediate transfer belt 52 is varied according to the amount of toner particles adhering to the intermediate transfer belt 52. In the printer 1 of this embodiment, as the intermediate transfer belt 52, for example, a rubber belt can be employed whose friction coefficient is large. However, as a result of putting an appropriate amount of toner particles, that rubber belt is placed in a state in which such ultra-small-size particles are affixed to a surface thereof, exhibiting its tendency to decrease the friction coefficient. On the contrary, when the amount of the toner particles is increased further, the rubber belt exhibits accordingly great friction coefficient (this is because, when the toner particles are increased, they are scraped, for example, through an operation of the belt cleaning apparatus 58, etc).

Various factors are related to the friction coefficient, such as the kind and the diameter of toner particles, a material of the intermediate transfer belt 52, a material of the photoconductive drum 9, and operational conditions of the belt cleaning apparatus 58. Therefore, characteristics plotted in FIG. 11B are given by way of example only. However, a change in the amount of the toner particles at the intermediate transfer belt 52 gives rise to a change in the friction coefficient of the intermediate transfer belt 52. Moreover, typically, the toner particles are not uniformly distributed on the intermediate transfer belt 52. Thus, the friction coefficient of the belt surface varies depending on part thereof, leading to unstable rotation (unstabilized speed of rotation) of the intermediate transfer belt 52 and hence of the photoconductive drum 9 coming into contact with the intermediate transfer belt 52.

Such unstable rotation leads to a change in the peak-to-peak voltage at which the occurrence of electrical discharge is started. That is, the accuracy in setting the AC voltage Vpp1 for the image forming operation may be decreased. Moreover, such the unstable rotation results in displacement, etc. in transferring and forming a toner image in the image forming operation subsequent to the electrical discharge detecting operation. Thus, as shown in FIG. 11C, it is conceived that, so that the toner particles are prevented from moving onto the intermediate transfer belt 52, the control portion 10 sends an instruction to the transfer voltage applying portion 59 whereby the transfer voltage applying portion 59 applies a voltage having a same polarity as that of the toner particles (hereinafter, referred to as "reverse bias" with a positive polarity in this embodiment) to the primary transfer roller 51. This reverse bias prevents the toner particles from moving onto the intermediate transfer belt 52.

However, for surely avoiding the movement of the toner particles, a comparatively large reverse bias (e.g., sufficiently larger than the potential of electrical charges carried by the toner particles) needs to be applied to the primary transfer roller 51. With this, the photoconductive drum 9 is electrically charged as a result of receiving the reverse bias. The electrical-charge eliminating apparatus 31 is disposed in place where the photoconductive drum is arranged opposite the primary transfer roller 51, and the cleaning apparatus 32. However, the toner particles and dust, etc. carried on the photoconductive drum 9 block advancement of light, and thus, the electrical-charge eliminating apparatus 31 may fail to eliminate electrical charges satisfactorily. Accordingly, during the electrical discharge detecting operation, the surface potential of the photoconductive drum 9 is hardly stabilized according to the method shown in FIG. 11C.

Thus, according to the present invention, as shown in FIG. 11D, during the electrical discharge detecting operation, the control portion 10 (CPU 11) sends an instruction to the charge voltage applying portion 72 to thereby enable the charging apparatus 7 to electrically charge the photoconductive drum 9, so that the photoconductive drum 9 (its entire circumferential surface) continues to be exposed to the laser beam by the exposure apparatus 4. Thus, the surface potential of the photoconductive drum 9 is stabilized at approximately 0 V in a region L where the photoconductive drum 9 and the developing roller 81 face each other. As a result, such an ambiguous condition where electrical discharge may or may not occur (variation in probability that electrical discharge will occur) is eliminated. Moreover, the potential difference between the photoconductive drum 9 and the developing roller 81 leading to electrical discharge can be grasped with accuracy. That is, according to the present invention shown in FIG. 11D, the charging apparatus 7 electrically charges the photoconductive drum 9, the photoconductive drum 9 is exposed, and the reverse bias is then applied to the primary transfer roller 51.

Generally, as a result of electrically charging performed by the charging apparatus 7, ozone and other electrical charge by-products are generated. This ozone reacts with the surface of the photoconductive drum 9, and accordingly, the surface of the photoconductive drum 9 tends to adsorb water. The adsorbing of water leads to decreased resistance of the photoconductive drum 9. Moreover, when an electrical charge by-product dissolves into water to change into ions, the resistance of the photoconductive drum 9 tends to be further decreased. With a decreased resistance of the photoconductive drum 9, electrical charges start to travel with the result that an electrostatic latent image is disturbed.

Such disturbance of an electrostatic latent image leads to a degraded quality of an image (producing a disturbed image). Moreover, if the electrical discharge by-products are piled up and fixed on the photoconductive drum 9, the friction coefficient of the photoconductive drum 9 is caused to vary, leading to unstable rotation of the photoconductive drum 9. Note that, only when the image forming operation is performed, production of a disturbed image or electrical charge by-products being fixed on the surface can be avoided to some extent with the help of the toner particles acting like a polishing agent, and polishing and cleaning effects achieved by the cleaning apparatus 32.

However, when the electrical discharge detecting operation is performed, since the developing roller 81 is basically made to carry no toner particles, a problem arising from electrical charge by-products tends to be obvious there. Thus, it may be advisable to stabilize the surface potential of the photoconductive drum 9 when engaging in the electrical discharge detecting operation. Therefore, with an instruction from the control portion 10, the charge voltage applying portion 72 is limited to applying, for the electrical discharge detecting operation, a voltage lower than that for the image forming operation (e.g., reduced to 20 to 80% of the voltage for the image forming operation). Accordingly, with the voltage applied to the charging roller 71 lower than that for the image forming operation, the amount of ozone and other electrical charge by-products to be generated is reduced. Thus, according to the present invention, problems arising from electrical charge by-products and ozone are relaxed. In addition, with no increase in energy exerted by the laser beam from the exposure apparatus 4, the surface potential of the photoconductive drum 9 can be sufficiently lowered.

As described above, according to the second embodiment of the present invention, in a case where the occurrence of electrical discharge is detected and confirmed by changing the AC voltage applied to the developing roller 81 for the purpose of grasping the potential difference between the developing roller 81 and the photoconductive drum 9 at which the occurrence of electrical discharge is started, the charging portion (charging apparatus 7) electrically charges the photoconductive drum 9, and the exposure portion (exposure apparatus 4) exposes the entire circumferential surface of the photoconductive drum 9 to a laser beam. With this, the photoconductive drum 9 is electrically charged at a constant potential by the charging portion, and is then exposed to the laser beam. Thus, the surface potential (V0) of the photoconductive drum 9 thus exposed becomes stable (e.g., at approximately 0 V). With the surface potential of the photoconductive drum 9 serving as a reference stabilized, it is possible to grasp, with accuracy, the potential difference between the developing roller 81 and the photoconductive drum 9 at which the occurrence of electrical discharge is started.

Moreover, when the electrical discharge detecting operation is performed, the control portion 10, by sending an instruction to the transfer voltage applying portion 59, enables the transfer voltage applying portion 59 to apply a voltage having a polarity opposite to the polarity of the voltage for transfer, enables the charging portion to electrically charge the photoconductive drum 9, and then enables the exposure portion to expose an entire area of the circumferential surface of the photoconductive drum 9, respectively. With this, the toner particles on the photoconductive drum 9 can be prevented from moving toward the transfer members such as the intermediate transfer member and the transfer roller (e.g., intermediate transfer belt 52). As a result, the occurrence of unstable rotation of the transfer members, etc. and of the photoconductive drum 9 making contact therewith can be reduced. Moreover, during the image forming operation, the toner images can be formed and transferred correctly without being displaced. Furthermore, the control portion 10 sends an instruction so that a charge voltage from the charging portion (charging apparatus 7) is made lower than that for a normal printing operation; the surface potential of the photoconductive drum 9 can thus be stabilized as a result of the exposure done by the exposure portion.

Moreover, in the charging portion, a comparatively high voltage (e.g., several hundreds V to several kV) is applied for electrically charging the photoconductive drum 9, and as a result, ozone and other by-products are often generated. The production of these ozone and other electrical charge by-products possibly leads to unstable rotation of the rotation members and a degraded quality of resulting images. And according to the present invention, the charging portion performs electrically charging for the purpose of detecting and confirming the occurrence of electrical discharge; thus, if such a detecting operation lasts for a long time, ozone and other by-products may be increasingly generated. To cope with this, the control portion 10 sends, to the charging portion (charging apparatus 7), an instruction indicating a charge voltage from the charging portion is reduced compared with the charge voltage for the image forming operation. Accordingly, the amount of ozone and other by-products generated is reduced, and not only unstable rotation of the rotating members but also degradation of the quality of images during the image forming operation subsequent to the electrical discharge detecting operation can be obviated.

Moreover, the image forming apparatus 3 is further equipped with the cleaning portion (cleaning apparatus 32) cleaning the photoconductive drum 9; despite electrical charge by-products adhering to the photoconductive drum 9, the amount of such adherence can be reduced. This helps reduce a change in speed of rotation of the photoconductive drum 9, etc., and an extent of degraded quality of resulting images.

Third Embodiment

Next, a printer 1 according to a third embodiment of the present invention will be described with reference to FIGS. 12 to 15.

The third embodiment differs from the first and second embodiments in that an error, due to noise, in detecting the occurrence of electrical discharge is prevented with the focus on a deviation observed in the photoconductive drum 9 and the developing roller 81. In other words, the third embodiment differs from the other embodiments in that a noise-based-error in detecting the occurrence of electrical discharge is eliminated, and that control is performed whereby subtle electrical charge is detected with accuracy.

A configuration of the printer 1 of this embodiment may be the same as those of the first and second embodiments. For example, the foregoing descriptions given with reference to FIGS. 1 to 11 can be applied to the third embodiment. Thus, in the following description and drawings, no overlapping description of the same parts as in the first and second embodiments will be repeated unless necessary.

(Deviation Observed in the Photoconductive Drum 9 and the Developing Roller 81)

Figure 12A:
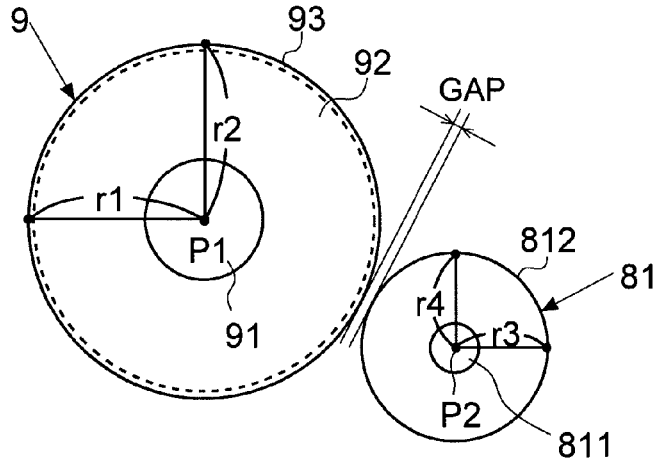
FIG. 12A, 12B, and 12C are explanatory views for illustrating deviations observed in a photoconductive drum and a developing roller according to a third embodiment of the present invention.
Figure 12B:
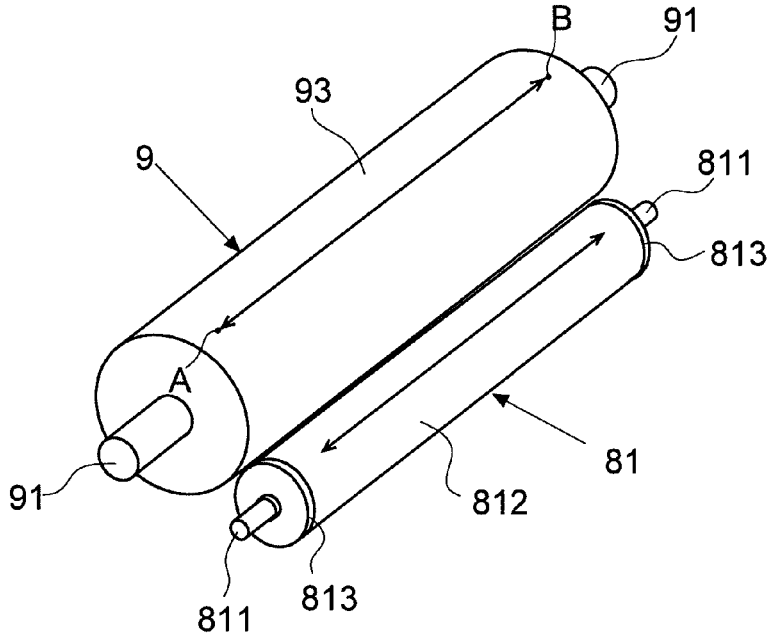
Figure 12C:
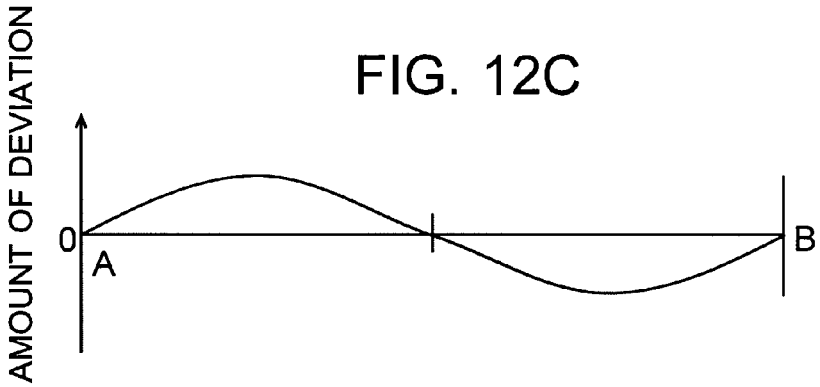

In this embodiment, an electrical discharge detecting operation is performed in consideration of a deviation observed in the photoconductive drum 9 and the developing roller 81 of this embodiment of the present invention. First, a deviation observed in the photoconductive drum 9 and the developing roller 81 will be described with reference to FIG. 12A, 12B, and 12C. FIGS. 12A, 12B, and 12C are explanatory diagrams illustrating a deviation observed in the photoconductive drum 9 and the developing roller 81 of the third embodiment of the present invention.

FIG. 12A will be described. FIG. 12A shows an example of a sectional view, as seen from an axial direction, of the photoconductive drum 9 and the developing roller 81. In the photoconductive drum 9, a radius of the photoconductive drum 9, namely a distance from an axial point P1 of a roller shaft 91 to the circumferential surface of the photoconductive drum 9 (represented, for example, by "r1" and "r2" in the figure) may vary depending on a point taken on a circumference of the photoconductive drum 9 (e.g., a relationship expressed by r1≠r2 is established).

This is partly because, for example, it is difficult to form a base body 92 of the photoconductive drum 9 (base body portion represented by a dotted line in FIG. 12A) to be true circle around the axial point P1. Moreover, the photoconductive drum 9 of this embodiment is so formed as to have the positively-charged amorphous-silicon photoconductive layer (a portion between the dotted line and a solid line) formed on the aluminum-made base body 92 by vapor deposition and the like (whereas, other portions such as an OPC photoconductive body are formed by coating), and the difficulty in making these layer (and coated film) perfectly uniform in thickness is another reason. Apart from these factors, normally, there is a deviation from an ideal cylindrical shape in the photoconductive drum 9.

The developing roller 81 is the same as the photoconductive drum 9 in that it has a deviation as described above. The developing roller 81 of this embodiment is formed with the sleeve 812 and the like. For example, the sleeve 812 and the like are made of metal such as aluminum, and therefore, are susceptible to errors when being manufactured; a radius, namely a distance from an axial point P2 of a roller shaft 811 to its circumferential surface (represented, for example, by "r3" and "r4" in the figure) may vary depending on a point on a circumference of the developing roller 81 (e.g., a relationship expressed by r3≠r4 is established).

Such deviations as described above can also be observed at any point in the axial direction represented by arrowed lines in FIG. 12B. In short, there is a variation in the amount of deviations measured on the circumferential surfaces of the photoconductive drum 9 and the developing roller 81 (specifically, sleeve 812 thereof). Thus, strictly speaking, a length of a gap between the photoconductive drum 9 and the developing roller 81—an important factor in producing electrical discharge therebetween—is varied depending on rotation of the photoconductive drum 9 and the developing roller 81.

FIG. 12C shows, by way of example, the amount of a deviation observed in the axial direction at one point on the circumferential surface of the photoconductive drum 9. A vertical axis represents the amount of a deviation observed in the photoconductive drum 9, and a horizontal axis represents a position along an axis extending from one end to the other end of the photoconductive drum 9 (e.g., from point A to point B in FIG. 12B). And as shown in FIG. 12C, for example, a deviation expressed in the shape of a sine waveform is observed. In practice, the amount of a deviation is not limited to the example shown in FIG. 12C; it may be variable, or may be simply large at one point, meaning a deviation does not always emerge in a predetermined pattern. In this way, the photoconductive drum 9 and the developing roller 81 produce deviations in various ways.

With that, strictly speaking, the length of the gap affecting the occurrence of the electrical discharge is varied as the photoconductive drum 9 and the developing roller 81 rotate. Electrical discharge tends to occur when part of the photoconductive drum 9 and the developing roller 81 producing a large deviation therebetween reaches a facing point where the two members face each other and accordingly the gap therebetween becomes narrowest. Thus, in this embodiment, the photoconductive drum 9 and the developing roller 81 are made to rotate at least twice or more during the electrical discharge detecting operation in one step. Accordingly, that part producing a large deviation is allowed to reach the facing point at least twice. Thus, possibility is increased that electrical discharge, if any, is detected twice or more.

Moreover, in this embodiment, when electrical discharge is detected twice or more, the control portion 10 considers it as the occurrence of electrical discharge and then reaches a conclusion accordingly. With this, even if an output signal received from the detecting portion 14 simply exceeds a predetermine threshold owing to noise, the control portion 10 is prevented from considering it as the occurrence of electrical discharge. Thus, in this embodiment, it is possible to reduce an error, due to noise, in detecting the occurrence of electrical discharge.

(Relationship of Noise and Threshold and Error in Electrical Discharge Detection)

Figure 13:
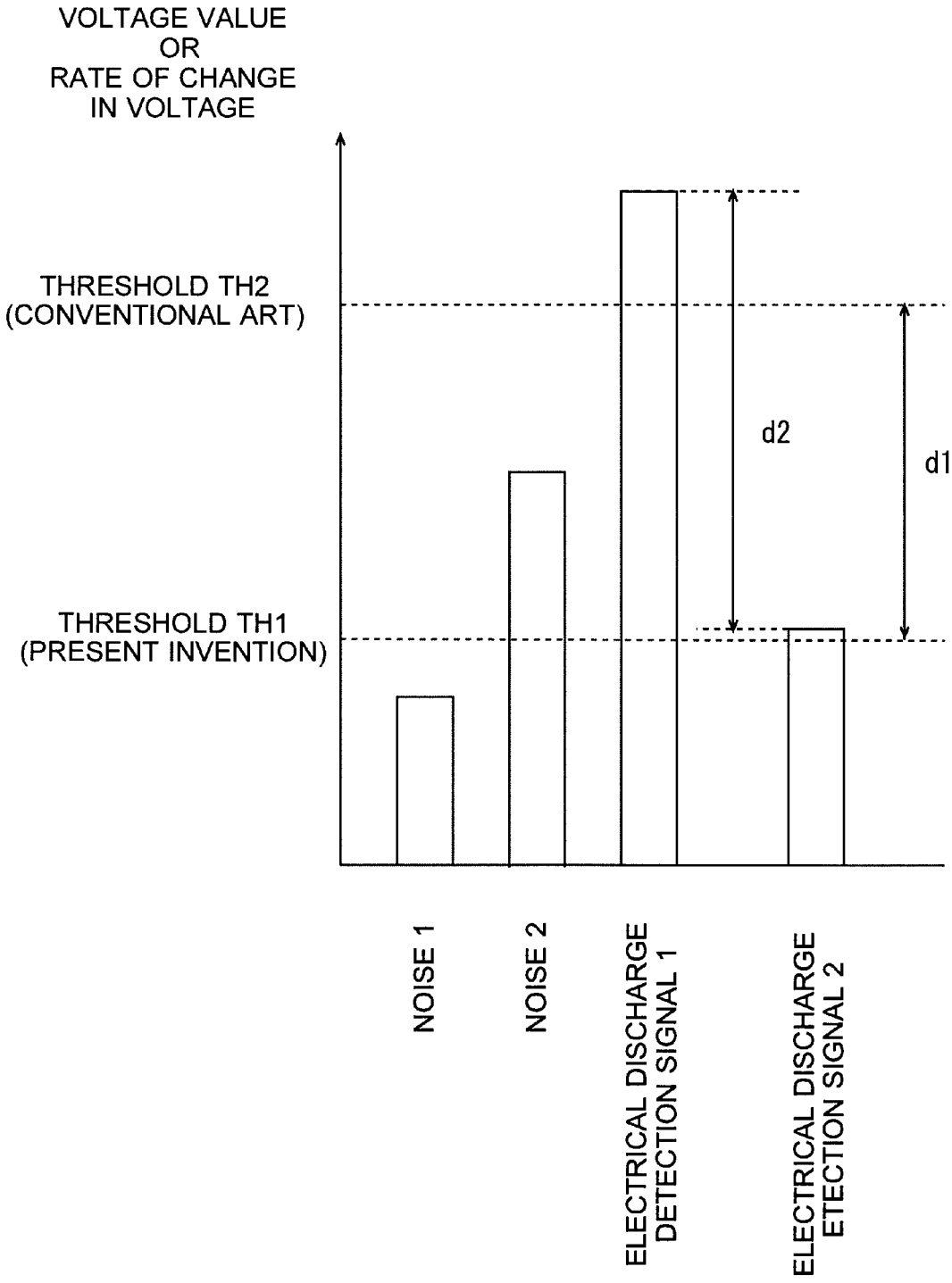
FIG. 13 an explanatory view for illustrating a threshold for an electrical discharge detection signal of a printer according to the third embodiment of the present invention.

Next, a relationship of noise and errors in detecting the occurrence of electrical discharge and thresholds in the printer 1 according to the third embodiment of the present invention will be described with reference to FIG. 13. FIG. 13 is an explanatory diagram regarding thresholds of the electrical discharge detection signal in the printer 1 according to the third embodiment of the present invention.

First, in this embodiment, a configuration for detecting the occurrence of electrical discharge is the same as in the first and second embodiments (see FIG. 4, step S8 and step S14 shown in FIGS. 9 and 10, respectively). Specifically, the control portion 10 (CPU 11) references an output (the electrical discharge detection signal) from the detecting portion 14 (amplifier 15), and then determines whether or not electrical discharge has occurred depending on whether or not that output exceeds a predetermined threshold. That is, the detecting portion 14 converts a current passing through the developing roller 81 owing to electrical discharge into a voltage. Then, that voltage is outputted as the electrical discharge detection signal to the control portion 10. The control portion 10 has a threshold for a voltage value indicated by the electrical discharge detection signal that is transmitted from the detecting portion 14. The control portion 10 determines whether or not the voltage value exceeds the threshold, and then finds out, based on the determination thus made, whether or not electrical discharge has occurred. More specifically, the control portion 10 (CPU 11) converts an analog output voltage value from the detecting portion 14 on a digital basis, and then compares a resulting value with the threshold.

Moreover, when it comes to noise, examples thereof include noise generated by an electromagnetic wave, etc. from various circuits incorporated in the printer 1 (such as the AC voltage applying portion 86 and the charge voltage applying portion 72). Furthermore, in principle, the developing roller 81 carries no toner particles, for example, when engaging in the electrical discharge detecting operation. However, the toner particles left on the sleeve 812 may be attracted toward the photoconductive drum 9, and such attraction of the toner particles bearing electrical charges can be considered as a kind of current.

If a large current is passed by electrical discharge, it is easy to detect that electrical discharge. With that, however, the photoconductive drum 9 may possibly be damaged (e.g., a drum pinhole is formed that penetrate through the photoconductive layer and the base body). Thus, according to the present invention, the occurrence of electrical discharge is detected at a stage where it is still minute (where discharge current is minute). However, when an attempt is made to detect a minute electrical discharge, its occurrence is highly likely to be detected incorrectly because of the presence of noise.

This will be described with reference to FIG. 13. In FIG. 13, examples of a voltage value indicated by the electrical discharge detection signal, which is inputted in the control portion 10, are aligned along horizontally. Specifically, first and second bars from left in the figure depict the voltage values of two different noises, respectively, (labeled with NOISE 1 and NOISE 2 in the figure) that may be inputted in the control portion 10. And third and fourth bars counted from left in FIG. 13 (labeled with ELECTRICAL DISCHARGE DETECTION SIGNAL 1 and ELECTRICAL DISCHARGE DETECTION SIGNAL 2) depict, as an example, voltage values indicated by the electrical discharge detection signal for the electrical discharge detecting operation. Additionally, a vertical axis in FIG. 13 depicts a magnitude of the voltage value indicated by the electrical discharge detection signal inputted in the CPU 11.

A problem emerging when the present invention is not practiced will be described by referring to noises 1 and 2 as examples. In a case where the present invention is not practiced, when a threshold for checking whether or not electrical discharge occurs is set to a threshold TH1 (represented by THRESHOLD TH1 (PRESENT INVENTION) in FIG. 13), for example, the CPU 11 finds out nose 1 falling below the threshold TH1, and thus, does not detect it as electrical discharge incorrectly. On the other hand, the CPU 11, when receiving noise 2 exceeding the threshold TH1, recognizes it as the occurrence of electrical discharge.

Accordingly, so that even if noise is inputted in the control portion 10, that noise is not incorrectly detected as electrical discharge, a threshold needs to be set sufficiently large compared with the noises likely to occur. An example of such a sufficiently large threshold is a threshold TH2 represented by "THRESHOLD TH2 (CONVENTIONAL ART)" in FIG. 13. Note that if the threshold takes a value as large as the threshold TH2, only electrical discharge exceeding the threshold TH2 can be detected.

Figure 14:
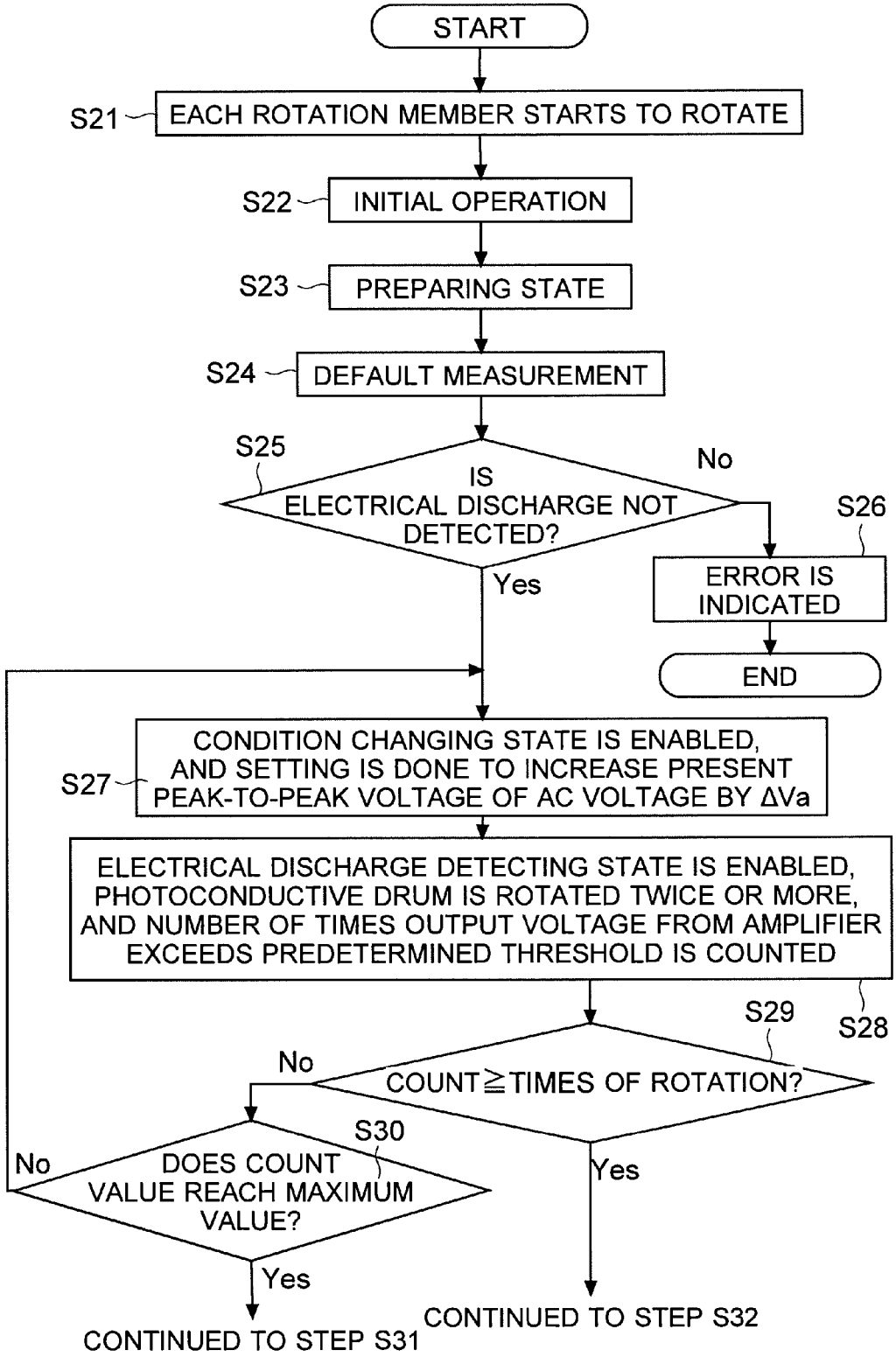
FIG. 14 is a flow chart depicting, as an example, a series of steps involved in controlling the electrical discharge detecting operation performed by the printer according to the third embodiment of the present invention.
Figure 15:
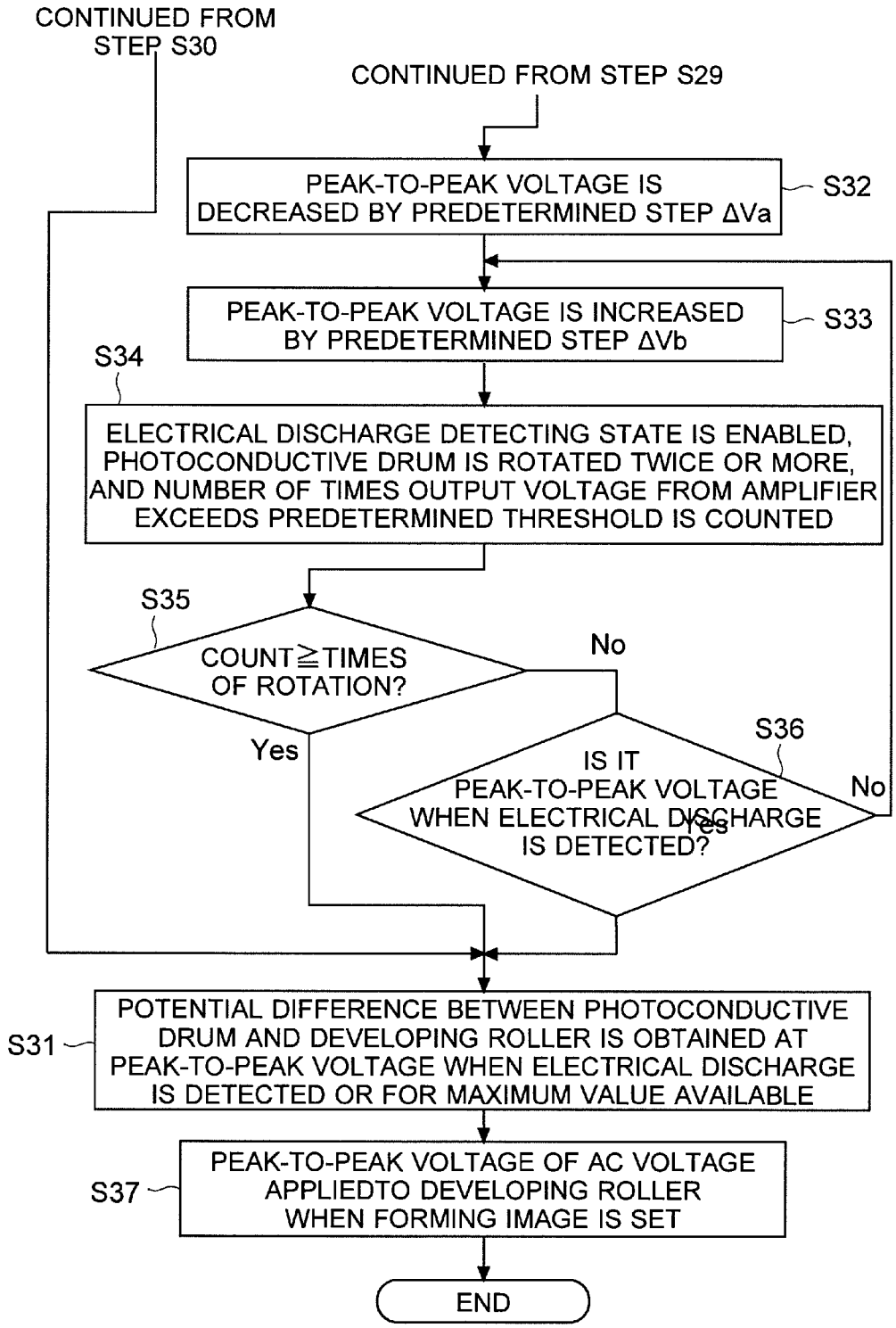
FIG. 15 is a flow chart depicting, as an example, the series of steps involved in controlling the electrical discharge detecting operation performed by the printer according to the third embodiment of the present invention.
Figure 16:
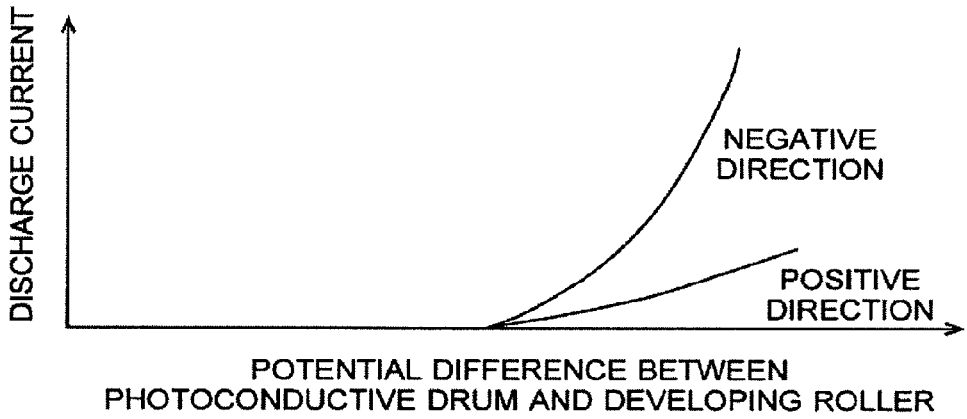
FIG. 16 is a graph showing, by way of example, a relationship of a discharge current passing between the photoconductive drum and the developing roller versus a potential difference between the photoconductive drum and the developing roller.

By contrast, according to the present invention, in the electrical discharge detecting state, unless the electrical discharge detection signal whose value exceeds the threshold is inputted in the control portion 10 a plurality of times (e.g., equal to or more than twice), the control portion 10 does not reach a conclusion that electrical discharge has occurred (see step S29 in FIG. 14, and step S35 in FIG. 15). For example, even if the control portion 10 receives noise a number of times fewer than a number of times a rotation member rotates in one step (e.g., for a case where the photoconductive drum 9 rotates twice, even if the control portion 10 receives the electrical discharge detection signal whose value exceeds, the threshold the number of times fewer than twice), the control portion 10 does not reach a conclusion that electrical discharge has occurred.

Thus, with the printer 1 of this embodiment, for the electrical discharge detecting operation, the threshold can be set far lower than the threshold TH2 (e.g., half the threshold TH2 or lower with its difference from the threshold TH2 represented by dl in the figure). So long as the threshold can be made greatly lower than that according to the conventional art for the electrical discharge detecting operation, represented by "THRESHOLD TH1" in the figure, a minute discharge current represented by "ELECTRICAL DISCHARGE DETECTION SIGNAL 2" in FIG. 13 can be detected correctly. That is, where an AC voltage starting electrical discharge is found out by increasing the AC voltage applied to the developing roller 81 step by step for the electrical discharge detecting operation, minute electrical discharge is also found out thereby; an AC voltage close to a true value of a voltage starting electrical discharge (of the potential difference between the photoconductive drum 9 and the developing roller 81 at which electrical discharge occurs) can be identified with increased accuracy. Thus, the AC voltage to be applied to the developing roller 81 for the image forming operation can be set appropriately.

(Procedure for Controlling the Operation for Detecting the Peak-to-Peak Voltage at which the Occurrence of Electrical Discharge is Started)

Next, a series of steps involved in controlling the peak-to-peak voltage at which the occurrence of electrical discharge is started in the printer 1 according to the third embodiment of the present invention will be described as an example with reference to FIGS. 14 and 15. FIGS. 14 and 15 together depict a flow chart illustrating, by way of example, a procedure for controlling the electrical discharge detection operation performed by the printer 1 according to the third embodiment of the present invention.

The chart is divided into two sections depicted in FIGS. 14 and 15, and depicts a series of steps involved in controlling the operation for detecting the peak-to-peak voltage at which the occurrence of electrical discharge is started. Moreover, the flow chart depicts control performed on one image forming apparatus 3; therefore, the control is in practice performed four times for the four colors. No overlapping description on the same parts as specifically described in the first embodiment with reference to FIGS. 9 and 10 will be repeated unless necessary.

First, "START" to step S27 in FIG. 14 correspond to step S1 to step S7 in FIG. 9, and therefore are omitted from the following detailed descriptions. Operations executed in a step subsequent to step S27 are the same as in the first and second embodiments, such as enabling the electrical discharge detecting state, and applying an AC voltage whose peak-to-peak voltage is increased by ΔVa to the developing roller 81. Moreover, the following operations are performed as in the first and second embodiments: in the electrical discharge detecting state, the exposure is performed according to an instruction from the control portion 10 (CPU 11), and the CPU 11 counts the number of times the output voltage of the amplifier 15 (electrical discharge detection signal) exceeds a predetermined threshold. The third embodiment, however, differs from the first and second embodiments in that the photoconductive drum 9 and the developing roller 81 are rotated twice or more in the electrical discharge detecting state (step S28).

The number of times the photoconductive drum 9 (developing roller 81) rotates while in the electrical discharge detecting state is not particularly limited. The electrical discharge detecting state is enabled while either of the rotation members having a longer circumferential length, namely the photoconductive drum 9 in this embodiment is rotated twice or more. So long as the circumferential speed of the developing roller 81 is equal to that of the photoconductive drum 9, the developing roller 81 whose circumferential length is shorter than the other is rotated twice or more (e.g., five times or more) while the other photoconductive drum 9 is rotated twice.

A time duration for enabling the electrical discharge detecting state is determined as follows: suppose that a rotation member is rotated, for example, twice, it is preferable that double the circumferential length of that rotation member and a rotation speed (circumferential speed), as defined as its specifications, of that rotation member be stored in the memory portion 12 as setup values, and that the counter 11*a* measure how long it takes for that rotation member to rotate twice (double the circumferential length÷rotation speed).

In this embodiment, for example, the memory portion 12 stores not only a program executed for setting the AC voltage applied to the developing roller 81 for the electrical discharge detecting operation, but also the threshold TH1 for the electrical discharge detecting operation. Moreover, the counter portion 11*a* can measure how long it takes for the photoconductive drum 9, the developing roller 81, and the like to rotate during the electrical discharge detecting operation (i.e., in the electrical discharge detecting state), and the control portion 10 can gasp the rotation speed, the circumferential length, and the number of times the rotation member, such as the photoconductive drum 9, rotates.

Then, the control portion 10 checked that a resulting count is not less than a value, either smaller, commensurate with the number of times the photoconductive drum 9 or the developing roller 81 rotates (step S29); if the resulting count is less than the value commensurate with the number of times of rotation (No in step S29), then the control portion 10 (CPU 11) considers it as the non-occurrence of electrical discharge. Then, the control portion (CPU 11) checks whether or not the present peak-to-peak voltage reaches the maximum value available (e.g., 1500 V to 3000 V) (step S30); if it reaches that maximum value (Yes in step S30), then the ongoing process proceeds to step S31 (which will be described in detail later). Otherwise, namely if it does not reach that maximum value (No in step S30), the ongoing process returns to step S27. If the resulting count is equal to or more than the value commensurate with the number of times of rotation (Yes in step S29), the ongoing process proceeds to step S32. Operations executed in steps S32 and S33 are the same as those executed in steps S12 and S13 depicted in FIG. 10, and therefore are not specifically described here.

In step S34 subsequent to step S33, the electrical discharge detecting state is enabled as in step S28. Then, the control portion 10 (CPU 11) enables the photoconductive drum and the like to rotate twice or more, and counts the number of times the output voltage (electrical discharge detection signal) of the amplifier 15 exceeds the predetermined threshold (step S34). In other words, if electrical discharge is detected with the peak-to-peak voltage gradually increased by step ΔVa, the electrical discharge detecting state and the condition changing state are alternately repeated until electrical discharge is detected, under conditions that the peak-to-peak voltage is increased by step ΔVb, so that the peak-to-peak voltage at which the occurrence of electrical discharge is started is more specifically obtained.

Next, as in step S29, the control portion 10 checks that the resulting count is not less than a value, either smaller, commensurate with the number of times the photoconductive drum 9 or the developing roller 81 rotates (step S35). Then, if the resulting count is less than the value commensurate with the number of times of rotation (No in step S35), the ongoing process returns to step S36. On the other hand, if the resulting count is more than the value commensurate with the number of times of rotation (Yes in step S35), the control portion 10 (CPU 11) considers electrical discharge occurring at the present peak-to-peak voltage (the peak-to-peak voltage at which the occurrence of electrical discharge is started), and the ongoing process proceeds to step S31.

Operations executed in steps S31, S36, and S37 are the same as those executed in steps S11, S16, and S17 in the first embodiment depicted in FIG. 10, and therefore are not specifically described.

Electrical discharge tends to occur when part of the photoconductive drum 9 and the developing roller 81 producing a large deviation therebetween reaches the facing point where the two members face each other and accordingly the gap therebetween becomes narrowest. In this embodiment, when the electrical discharge detecting operation is performed under conditions that the AC voltage is changed by one step, the photoconductive drum 9 and the developing roller 81 are individually rotated at least twice or more. Accordingly, that part producing a large deviation is allowed to reach the facing point at least twice. That is, there is a strong possibility that electrical discharge, if any, can be detected twice or more.

In this embodiment, while the electrical discharge detecting operation is in progress under the same condition mentioned above, if the control portion 10 receives, from the detecting portion 14, the output indicating the occurrence of the electrical discharge twice or more, the control portion 10 recognizes the occurrence of electrical discharge. Thus, the control portion 10, simply receiving noise, does not reach a conclusion that electrical discharge has occurred. This helps reduce an error, due to noise, in detecting electrical discharge; accordingly, electrical discharge can be detected correctly.

Moreover, the control portion 10 has the threshold of the voltage value indicated by the electrical discharge detection signal which is transmitted from the detecting portion 14, and recognizes the occurrence or non-occurrence of electrical discharge depending on whether or not the voltage value exceeds the threshold. In this embodiment, with no error in detecting electrical discharge owing to noise, the threshold can be set lower. Moreover, with that, even a minute electrical discharge can be detected. Accordingly, during the electrical discharge detecting operation, the magnitude of an AC voltage at which the occurrence of electrical discharge is started can be measured and found out, with increased accuracy, for the AC voltage applied to the developing roller 81. Moreover, no large current needs to be passed during the electrical discharge detecting operation; this helps eliminate damage on the photoconductive drum 9 leading to the degraded quality of an image to be formed.

Although the foregoing descriptions deal with the embodiments of the present invention, the scope of the present invention is not limited to that encompassed thereby, and the present invention can be practiced in any way by making various changes thereto without departing from the spirit of the invention.

What is claimed is:

1. An image forming apparatus comprising:

a photoconductive drum that carries a toner image on a circumferential surface thereof;

a developing roller that is arranged opposite the photoconductive drum with a gap in between, and that carries toner when engaging in an image forming operation;

a detecting portion that detects an occurrence of electrical discharge between the photoconductive drum and the developing roller;

a control portion that controls the apparatus, that receives an output of the detecting portion, and that recognizes, based on the output, the occurrence of the electrical discharge;

a direct voltage applying portion that is connected to the developing roller so as to supply toner to the photoconductive drum; and an alternating voltage applying portion that is connected to the developing roller so as to supply the toner to the photoconductive drum, and that, when an electrical discharge detecting operation is performed in which the occurrence of the electrical discharge is detected by use of the detecting portion with an alternating voltage applied to the developing roller changed step by step in accordance with an instruction from the control portion, applies, to the developing roller, the alternating voltage having a duty ratio and a frequency different from the alternating voltage applied for the image forming operation, so that the electrical discharge is made to occur simply in a direction in which an increase in current induced by the electrical discharge is smaller for an increase in potential difference, grasped in advance, between the photoconductive drum and the developing roller.

2. The image forming apparatus according to claim 1, wherein the photoconductive drum has a photoconductive layer formed of amorphous silicon and positively charged, and the alternating voltage applying portion applies, to the developing roller for the electrical discharge detecting operation, the alternating voltage having the duty ratio and the frequency smaller than the alternating voltage applied for the image forming operation, the frequency being set smaller so that a period on a positive side of the alternating voltage becomes equal to a period on the positive side of the alternating voltage applied for the image forming operation.

3. The image forming apparatus according to claim 2, wherein if the occurrence of the electrical discharge is detected when the electrical discharge detecting operation is performed, the control portion obtains a potential difference between the photoconductive drum and the developing roller at a peak value of the alternating voltage applied to the developing roller when the electrical discharge has occurred, and then determines an alternating voltage to be applied to the developing roller for the image forming operation, so that a surface potential difference between the photoconductive drum and the developing roller for the image forming operation becomes smaller than the potential difference thus obtained.

4. The image forming apparatus according to claim 2, wherein the detecting portion converts current passing through the developing roller owing to the electrical discharge into voltage, and then outputs the voltage to the control portion as an electrical discharge detection signal, and the control portion recognizes the occurrence or non-occurrence of the electrical discharge depending on whether or not a voltage value indicated by the electrical discharge detection signal transmitted from the detecting portion exceeds a threshold.

5. The image forming apparatus according to claim 2, wherein the control portion monitors a change in a signal received from the detecting portion, and calculates a rate of change in the voltage value indicated by the signal, the control portion recognizing the occurrence or non-occurrence of the electrical discharge depending on whether or not the rate of change exceeds a threshold, and the threshold is provided for the rate of the change in the voltage value indicated by the signal.

6. The image forming apparatus according to claim 2, further comprising:

a magnetic roller that supplies the toner to the developing roller, wherein the magnetic roller supplies the toner to the developing roller before the developing roller receives the alternating voltage for the electrical discharge detecting operation.

7. The image forming apparatus according to claim 1, further comprising:

a magnetic roller that is arranged opposite the developing roller, and that retains the toner being positively charged, wherein when the electrical discharge detecting operation is performed, the control portion enables the direct voltage applying portion to apply, to the developing roller, a direct voltage higher than the direct voltage applied for the image forming operation.

8. The image forming apparatus according to claim 1, further comprising:

a charging portion that electrically charges the photoconductive drum at a constant potential;

an exposure portion that exposes the photoconductive drum electrically charged by the charging portion, and that thereby forms an electrostatic latent image; and a transfer portion that is connected to a transfer voltage applying portion applying a voltage for transfer, and that thus transfers a toner image to an intermediate transfer member or a sheet, wherein when the electrical discharge detecting operation is performed, the control portion, by sending an instruction to the transfer voltage applying portion, enables the transfer voltage applying portion to apply a voltage having a polarity opposite to the polarity of the voltage for transfer, enables the charging portion to electrically charge the photoconductive drum, and then enables the exposure portion to expose an entire area of the circumferential surface of the photoconductive drum, respectively.

9. The image forming apparatus according to claim 8, wherein when the electrical discharge detecting operation is performed, the control portion sends, to the charging portion, an instruction indicating a charge voltage from the charging portion is reduced compared with the charge voltage for the image forming operation.

10. The image forming apparatus according to claim 8, further comprising:

a cleaning portion that cleans the photoconductive drum.

11. The image forming apparatus according to claim 8, wherein if the occurrence of the electrical discharge is detected when the electrical discharge detecting operation is performed, the control portion obtains a potential difference between the photoconductive drum and the developing roller at a peak value of the alternating voltage applied to the developing roller when the electrical discharge has occurred, and then determines an alternating voltage to be applied to the developing roller for the image forming operation, so that a surface potential difference between the photoconductive drum and the developing roller for the image forming operation becomes smaller than the potential difference thus obtained.

12. The image forming apparatus according to claim 1, wherein when the electrical discharge detecting operation is performed under a condition that the alternating voltage is changed by one step, the photoconductive drum and the developing roller are individually rotated at least twice or more, and while the operation is in progress under the same condition, if the control portion receives an output from the detecting portion twice or more, the control portion recognizes the occurrence of the electrical discharge.

13. The image forming apparatus according to claim 12, wherein if the occurrence of the electrical discharge is detected when the electrical discharge detecting operation is performed, the control portion obtains a potential difference between the photoconductive drum and the developing roller at a peak value of the alternating voltage applied to the developing roller when the electrical discharge has occurred, and then determines an alternating voltage to be applied to the developing roller for the image forming operation, so that a surface potential difference between the photoconductive drum and the developing roller for the image forming operation becomes smaller than the potential difference thus obtained.

14. The image forming apparatus according to claim 1, wherein if the occurrence of the electrical discharge is detected when the electrical discharge detecting operation is performed, the control portion obtains a potential difference between the photoconductive drum and the developing roller at a peak value of the alternating voltage applied to the developing roller when the electrical discharge has occurred, and then determines an alternating voltage to be applied to the developing roller for the image forming operation, so that a surface potential difference between the photoconductive drum and the developing roller for the image forming operation becomes smaller than the potential difference thus obtained.

15. The image forming apparatus according to claim 1, wherein the detecting portion converts current passing through the developing roller owing to the electrical discharge into voltage, and then outputs the voltage as an electrical discharge detection signal to the control portion, and the control portion recognizes the occurrence or non-occurrence of the electrical discharge depending on whether or not a voltage value indicated by the electrical discharge detection signal transmitted from the detecting portion exceeds a threshold.

16. The image forming apparatus according to claim 1, wherein the control portion monitors a change in a signal received from the detecting portion, and calculates a rate of change in the voltage value indicated by the signal, the control portion recognizing the occurrence or non-occurrence of the electrical discharge depending on whether or not the rate of change exceeds a threshold, and the threshold is provided for the rate of the change in the voltage value indicated by the signal.

17. The image forming apparatus according to claim 1, further comprising:

a magnetic roller that supplies the toner to the developing roller, wherein the magnetic roller supplies the toner to the developing roller before the developing roller receives the alternating voltage for the electrical discharge detecting operation.

* * * * *